US010555108B2

(12) United States Patent
Murata et al.

(10) Patent No.: US 10,555,108 B2
(45) Date of Patent: Feb. 4, 2020

(54) FILTER GENERATION DEVICE, METHOD FOR GENERATING FILTER, AND PROGRAM

(71) Applicant: JVC KENWOOD Corporation, Yokohama-shi, Kanagawa (JP)

(72) Inventors: Hisako Murata, Yokohama (JP); Sadahiro Yasura, Yokohama (JP); Takahiro Gejo, Yokohama (JP); Yumi Fujii, Yokohama (JP)

(73) Assignee: JVCKENWOOD Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 16/355,169

(22) Filed: Mar. 15, 2019

(65) Prior Publication Data

US 2019/0215640 A1 Jul. 11, 2019

Related U.S. Application Data

(63) Continuation of application No. PCT/JP2017/034026, filed on Sep. 21, 2017.

(30) Foreign Application Priority Data

Sep. 23, 2016 (JP) ..... 2016-185386

(51) Int. Cl.
*H04S 7/00* (2006.01)
*H04S 3/00* (2006.01)
(Continued)

(52) U.S. Cl.
CPC ..... *H04S 7/304* (2013.01); *H04R 1/1041* (2013.01); *H04R 1/406* (2013.01); *H04R 3/005* (2013.01);
(Continued)

(58) Field of Classification Search
CPC ..... H04S 7/304; H04S 3/008; H04S 2400/15; H04S 2420/01; H04R 1/1041; H04R 1/406; H04R 3/005; H04R 3/04
See application file for complete search history.

(56) References Cited

U.S. PATENT DOCUMENTS

2017/0373656 A1* 12/2017 Bharitkar ..... H04R 3/04

FOREIGN PATENT DOCUMENTS

JP 2002-209300 A 7/2002
JP 2015-126269 A 7/2015

OTHER PUBLICATIONS

Rasumow, Eugen et al., Smoothing individual head-related transfer functions in the frequency and spatial domains, Apr. 2014 , Acoustic Society of America vol. 135 No. 4 pp. 2012-2025.*
(Continued)

*Primary Examiner* — Andrew L Sniezek
(74) *Attorney, Agent, or Firm* — Procopio, Cory, Hargreaves & Savitch LLP

(57) ABSTRACT

A filter generation device according to this embodiment is configured to generate a filter for performing an out-of-head localization process on a high resolution digital audio signal, the filter generation device including: microphones; and a filter generation unit configured to generate a filter corresponding to a transfer characteristic from left and right speakers to the left and right microphones. A predetermined frequency lower than a Nyquist frequency of a sound pickup signal is assumed as a first frequency. The filter generation unit sets an amplitude component in a low frequency band of the filter corresponding to a frequency amplitude characteristic of the sound pickup signal, and the filter generation unit generates an amplitude component in a high frequency band of the filter such that the amplitude component in the
(Continued)

high frequency band is allowed to be connected to the amplitude component in the low frequency band.

16 Claims, 19 Drawing Sheets

(51) Int. Cl.
*H04R 1/10* (2006.01)
*H04R 3/00* (2006.01)
*H04R 3/04* (2006.01)
*H04R 1/40* (2006.01)

(52) U.S. Cl.
CPC ..... *H04R 3/04* (2013.01); *H04S 3/008* (2013.01); *H04S 2400/15* (2013.01); *H04S 2420/01* (2013.01)

(56) References Cited

OTHER PUBLICATIONS

Takemoto, H. et al., "Acoustic Simulation Techniques for Personalized Three-Dimensional Auditory Reproduction" Journal of the National Institute of Information and Communications Technology, 11 pages, vol. 56, Nos. 1/2, 2010; cited in specification; English abstract provided (http://www.nict.go.jp/publication/shuppan/kihou-journal/kihou-vol56no1_2/0403.pdf).

* cited by examiner

FILTER GENERATION DEVICE, METHOD FOR GENERATING FILTER, AND PROGRAM

CROSS REFERENCE TO RELATED APPLICATION

This application is based upon and claims the benefit of priority from Japanese patent application No. 2016-185386 filed on Sep. 23, 2016, and International application No. PCT/JP2017/034026 filed on Sep. 21, 2017, the disclosure of which are incorporated herein in its entirety by reference.

BACKGROUND

The present disclosure relates to a filter generation device, a method for generating a filter, and a program.

As disclosed in Patent Literature 1 (Japanese Unexamined Patent Application Publication No. 2002-209300), conventionally, there has been known a method which uses a head related transfer function HRTF of a listener as a method for localizing a sound image outside the head (see Patent Literature 1, for example). In the case where headphones or earphones are used, a head related transfer function from a virtual sound source to both ears of a listener and inverse characteristics of an ear canal transfer function ECTF are convolved to a reproduction signal. With such a configuration, characteristics of headphones or earphones are canceled so that although sounds are outputted from an area in the vicinity of ears, it is possible to reproduce a sound field as if the sounds were outputted from the direction of the virtual sound source. An ear canal transfer function ECTF is measured by inserting a measurement microphone into an ear canal of a listener, or using a dummy head as an alternative.

SUMMARY

Ideal sound localization is performed in a state where an ear canal is open. However, in an actual measurement, measurement is performed in a state where headphones or earphones are put on ears and hence, the ear canal is in a closed state. As a result, resonance occurs in the ear canal so that a peak or a dip is formed in a specific frequency. Convoluting inverse characteristics of an ear canal transfer function (also referred to as an "ear canal correction function") to a reproduction signal may reduce sound quality on auditory feeling. Also in reproducing a stereophonic sound field with a speaker using a head related transfer function, resonance may occur due to an influence of reflection or the like in a measurement space, thus deteriorating sound quality. It is difficult to detect a peak portion or a dip portion which is formed due to resonance from a waveform of a reproduction signal. Accordingly, there may be a case where a sound field cannot be properly reproduced.

According to one aspect of this embodiment, there is provided a filter generation device configured to generate a filter for performing an out-of-head localization process on a high resolution digital audio signal, the filter generation device including: left and right microphones configured to pick up a measurement signal outputted from a sound source so as to acquire a sound pickup signal, the left and right microphones being capable of being put on left and right ears of a listener; and a filter generation unit configured to generate, based on the sound pickup signal, a filter corresponding to a transfer characteristic from the sound source to the left and right microphones, wherein the sound pickup signal is a signal with a predetermined sampling frequency, and a predetermined frequency lower than a Nyquist frequency of the sound pickup signal is assumed as a first frequency, the filter contains an amplitude component in a low frequency band which includes a frequency equal to or lower than the first frequency, and an amplitude component in a high frequency band which includes a frequency higher than the first frequency, the filter generation unit sets the amplitude component in the low frequency band of the filter corresponding to a frequency amplitude characteristic of the sound pickup signal, and the filter generation unit generates the amplitude component in the high frequency band of the filter such that the amplitude component in the high frequency band is allowed to be connected to the amplitude component in the low frequency band.

According to another aspect of this embodiment, there is provided a method for generating a filter for performing an out-of-head localization process on a high resolution digital audio signal, the method including the steps of: outputting a measurement signal from a sound source; and picking up the measurement signal using left and right microphones capable of being put on left and right ears of a listener so as to acquire a sound pickup signal, wherein the method further includes the step of generating, based on the sound pickup signal, a filter corresponding to a transfer characteristic from the sound source to the left and right microphones, the sound pickup signal is a signal with a predetermined sampling frequency, and a predetermined frequency lower than a Nyquist frequency of the sound pickup signal is assumed as a first frequency, the filter contains an amplitude component in a low frequency band which includes a frequency equal to or lower than the first frequency, and an amplitude component in a high frequency band which includes a frequency higher than the first frequency, and in the step of generating the filter, the amplitude component in the low frequency band of the filter is set corresponding to a frequency amplitude characteristic of the sound pickup signal, and the amplitude component in the high frequency band of the filter is generated such that the amplitude component in the high frequency band is allowed to be connected to the amplitude component in the low frequency band.

According to still another aspect of this embodiment, there is provided a program configured to cause a computer to perform the above-described method for generating a filter.

According to this embodiment, it is possible to provide a filter generation device configured to generate a filter for a high resolution digital audio signal, a method for generating a filter, and a program.

DETAILED DESCRIPTION

A sound field reproduction device according to the present embodiment is briefly described. The sound field reproduction device according to the present embodiment measures a head related transfer characteristic (also referred to as a head related transfer function) of an individual or an ear canal transfer characteristic (also referred to as an ear canal transfer function) to realize a sound field reproduction such as an out-of-head localization using the characteristics. More specifically, the sound field reproduction device addresses a sound quality deterioration by eliminating influence of reflection in space at the time of measuring the transfer characteristic and the influence of resonance occurring due to the ear canal kept closed.

The present embodiment realizes a sound field processing such as an out-of-head localization using the head related transfer characteristic between the speaker and the ears of a listener or the ear canal transfer characteristic with headphones and earphones worn. In a space transfer characteristic such as a head related transfer characteristic or an ear canal transfer characteristic, influence of reflection in a measurement space causes resonance to cause a peak or a dip at high frequencies. Also in the measurement of the ear canal transfer characteristic, measurement is made with the ear canal kept closed to generate resonance, which can generate a peak or a dip at a high range. This is an individual characteristic resulting in an individual difference, can be perceived only by a listener and is difficult to automatically compensate.

Then, a frequency sweep signal (a sweep signal) in which frequency is gradually changed is used. While a listener listens to the frequency sweep signal, the listener operates a button when the listener perceives sound volume largely changed. This enables the position (frequency) of a peak or dip to be identified. The frequency of the peak or the dip is subjected to a notch filter or a peaking filter. This allows an unnecessary resonance to be removed to enable compensation to a flat frequency characteristic.

After the position (frequency) of the peak or the dip is identified by the above operation, frequencies in the vicinity of the position may be repetitively swept. The listener adjusting the peak level of the filter so that an audible sound volume is kept constant enables further fine correction.

In the out-of-head localization processing, it is preferable to apply AGC (automatic gain control) to prevent sound volume from being changed suddenly.

FIRST EMBODIMENT

Figure 1:
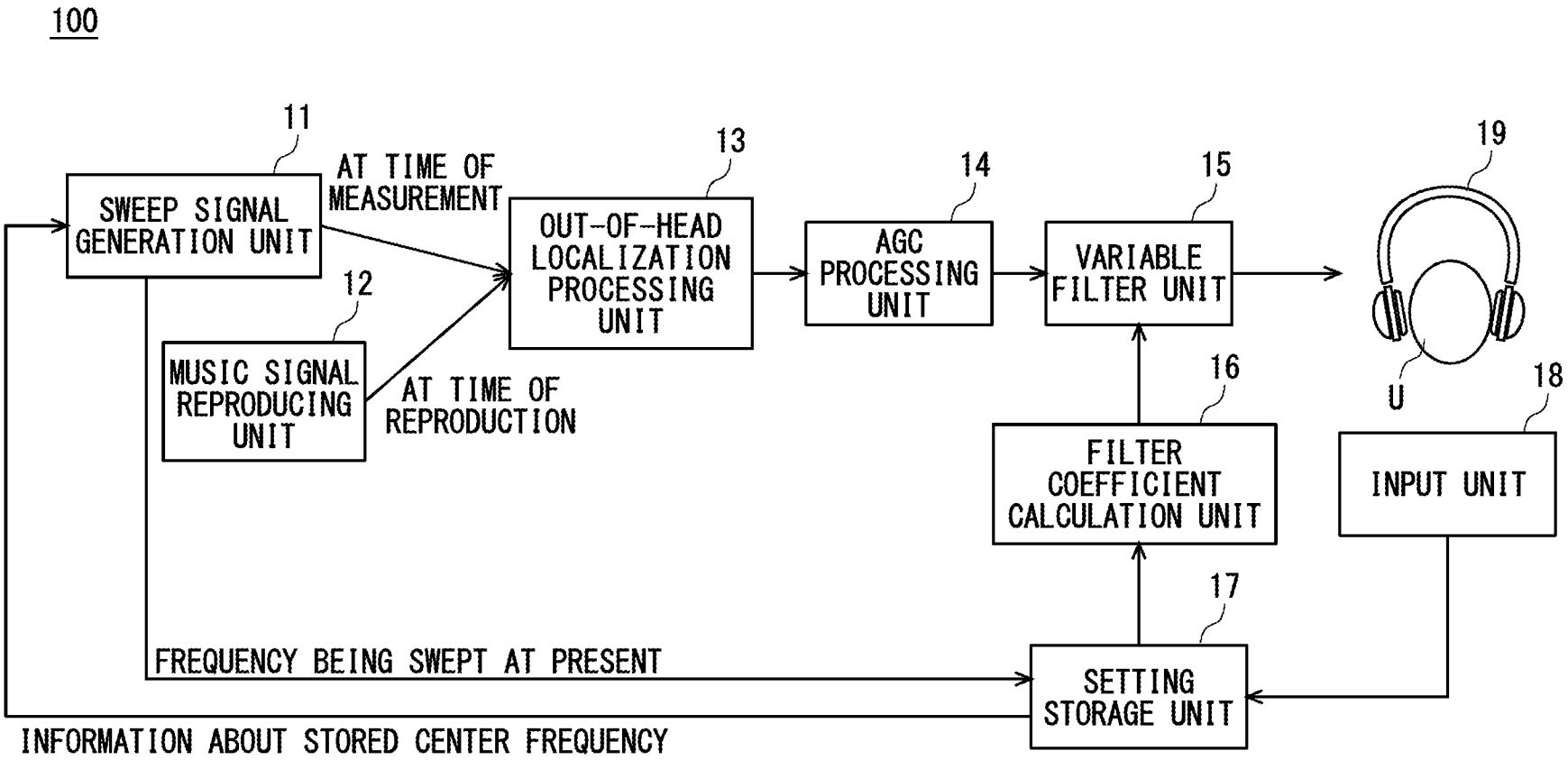
FIG. 1 is a block diagram showing a sound field reproduction device according to a first embodiment.

FIG. 1 illustrates a sound field reproduction device 100 according to the present embodiment. FIG. 1 is a block diagram showing the sound field reproduction device 100. The sound field reproduction device 100 reproduces a sound field for a listener U wearing headphones 19. For this reason, the sound field reproduction device 100 includes a sweep signal production unit 11, a music signal reproduction unit 12, an out-of-head localization unit 13, an AGC (Auto Gain Control) processing unit 14, a variable filter unit (filter unit) 15, a filter coefficient calculation unit 16, setting storage unit 17, an input unit 18, and headphones (output unit) 19. The AGC processing unit 14 may be eliminated. The AGC processing unit 14 may be caused to perform an AGC processing only in a sweep signal reproduction or a music signal reproduction.

The sound field reproduction device 100 is an information processing apparatus such as a personal computer, and includes a processing unit such as a processor, a storing unit such as a memory or a hard disk, a display device such as a liquid crystal monitor including an organic EL display or a plasma display, an input unit such as a touch panel, a button, a keyboard, and a mouse, and an output unit connected to a speaker and headphones. Alternatively, the sound field reproduction device 100 may be a smart phone or a tablet PC. The sound field reproduction device 100 may be configured such that the processing unit such as a processor and the storing unit such as a memory are incorporated in the speaker or the headphones as the output unit and the display unit such as the liquid crystal monitor and the input unit such as the touch panel may be connected to the headphones.

The sweep signal production unit 11 generates a frequency sweep signal in which a frequency changes. The sweep signal production unit 11 outputs a sinusoidal wave which gradually sweeps a predetermined sweep range as a frequency sweep signal. The frequency sweep signal is a pure tone, for example, and a signal whose center frequency is gradually changed. The sweep signal production unit 11 outputs the frequency sweep signal to the out-of-head localization unit 13. The frequency sweep signal is subjected to a processing described below and output from the headphones 19. The frequency of the frequency sweep signal increases at a regular speed. The frequency of the frequency sweep signal may continuously or stepwise increase. Alternatively, the frequency may be gradually decreased. The frequency sweep signal may be a stereo signal.

The music signal reproduction unit 12 reproduces a music signal previously recorded in a memory or a disk. The music signal reproduction unit 12 may not be provided inside the sound field reproduction device 100 and the music signal from an external sound source may be input to the out-of-head localization unit 13. The music signal, for example, may be a stereo signal output from an external CD player. The music signal is subjected to a filter processing described below and finally output from the headphones 19. The music signal is, for example, a stereo signal in which performance by a musical instrument or a natural voice is digitized and is output from the left and right units of the headphones 19. The music signal may be not only a signal in which performance by a musical instrument or a natural voice is digitized, but also a signal in which a sound audible to human ears, such as conversation, animal calls, ripples is digitized.

At a time of a music reproduction, the music signal reproduction unit 12 outputs the music signal to the out-of-head localization unit 13, and the sweep signal production unit 11 does not cause the frequency sweep signal to be generated. At a time of measuring a filter coefficient for adjusting a sound quality, the sweep signal production unit 11 outputs the frequency sweep signal to the out-of-head localization unit 13 and the music signal reproduction unit 12 does not reproduce the music signal. More specifically, the frequency sweep signal is output from the headphones 19 to perform measurement for eliminating resonance resulting in individual characteristics such as an ear canal contour. Thus, one of the music signal or the frequency sweep signal is input into the out-of-head localization unit 13. The following describes a processing for outputting the frequency sweep signal to measure the filter coefficient.

The out-of-head localization unit 13 subjects the frequency sweep signal to a convolution processing by using the ear canal transfer characteristic. More specifically, an inverse characteristic of previously measured ear canal transfer characteristic (also referred to as an ear canal correction function) is convoluted into the frequency sweep signal. The out-of-head localization unit 13 outputs the frequency sweep signal subjected to the convolution processing to the AGC processing unit 14. As described below, the out-of-head localization unit 13 convolutes the inverse characteristic of the ear canal transfer characteristic into the music signal.

Figure 2:
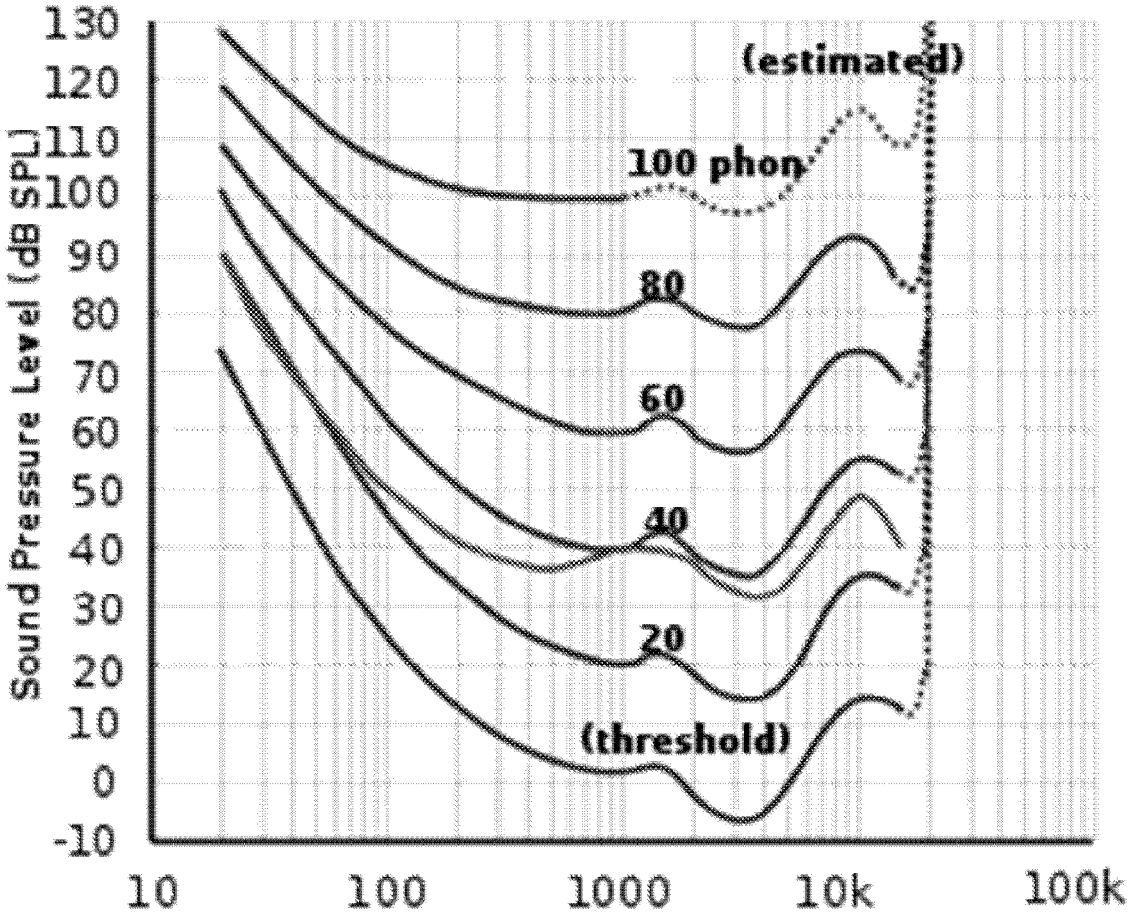
FIG. 2 illustrates an isophonic contour.

The AGC processing unit 14 performs a processing for keeping constant a signal level (loudness level) expressing auditory strength of sound of the frequency sweep signal. Even if a high-frequency sound and a low-frequency sound are same in sound pressure, the auditory strength of the sound felt by human auditory sense is different therebetween. The isophonic contour (loudness curve) expressing this characteristic is shown in FIG. 2. An abscissa and an ordinate in FIG. 2 show a frequency (Hz) and a sound pressure (dB) respectively. Each curve shows a relationship between frequency and sound pressure level for each signal level expressing auditory strength of sound. For example, if the auditory strength of sound is kept constant at 60 phones, this figure tells that sound pressure level needs to be varied according to frequencies. For this reason, when the frequency sweep signal is subjected to the out-of-head localization processing, the AGC processing unit 14 adjusts gain according to an isophonic contour. Gain at the AGC processing unit 14 varies according to sound volume, that is, sound pressure level, or frequency. The AGC processing unit 14 performs the AGC (automatic gain control) processing to adjust gain so that the frequency sweep signal can be kept to a constant signal level. This enables the listener U to listen to a sound at a constant signal level irrespective of frequencies of the sound. The AGC processed frequency sweep signal at the AGC processing unit 14 is output to the variable filter unit 15.

The variable filter unit 15 reads a filter coefficient calculated by the filter coefficient calculation unit 16 and sets filter such as a notch filter and a peaking filter. The variable filter unit 15 subjects the frequency sweep signal to a filter processing using the set filter. In an initial state, a filter with a flat characteristic is set to the filter coefficient calculation unit 16. For this reason, the frequency sweep signal from the AGC processing unit 14 is output to the headphones 19 without change.

The variable filter unit 15 outputs the frequency sweep signal to the headphones 19 without change. The headphones 19 output the frequency sweep signal to the listener U. The headphones 19 are stereo headphones and output the frequency sweep signal to the left and right ears of the listener U. The listener U listens to the frequency sweep signal output from the headphones 19.

The listener U confirms if sound volume suddenly changes while listening to the frequency sweep signal subjected to the out-of-head localization processing. The range of the frequencies to be swept is predetermined. In the measurement of the ear canal transfer function, resonance occurs at high frequencies, so that the range of sweeping the frequency sweep signals is 8 kHz to 20 kHz. Needless to say, the sweep range is not limited to 8 kHz to 20 kHz. The sweep range may be 5 kHz to 20 kHz, for example. In the sweep range, frequencies at which a peak/dip easily occurs are different depending on a measurement environment, so that it is desirable to determine the sweep range at your own discretion for each measurement environment. Needless to say, the entire reproduction frequency range of the headphones 19 may be taken as the sweep range. Alternatively, the listener U can designate the sweep range.

If sound volume suddenly changes while the listener U is listening to the frequency sweep signal, the listener U operates the input unit 18. The input unit 18 is provided with an input device such as a touch panel, a key board, a mouse, a push button, a lever, or dial. For example, if the listener U confirms a sudden change in sound volume while listening to the frequency sweep signal, the listener U pushes a frequency determination button provided on the input unit 18. Then, the input unit 18 receives the button operation performed by the listener U and outputs a signal according to the operation to the setting storage unit 17.

Frequencies which are now being swept are input to the setting storage unit 17 from the sweep signal production unit 11. The setting storage unit 17 includes a memory and stores the frequency of the frequency sweep signal at the time that the frequency determination button is pushed. In other words, the setting storage unit 17 stores the frequency at which sound volume suddenly changed. For example, the setting storage unit 17 stores the frequency at which sound volume suddenly decreased as a notch frequency. Alternatively, the setting storage unit 17 stores the frequency at which sound volume suddenly increased as a peak frequency. The setting storage unit 17 stores the frequency at which sound volume of the frequency sweep signal changes according to the operation of the listener U who listens to the frequency sweep signal output from the headphones 19.

The setting storage unit 17 outputs the stored frequency to the sweep signal production unit 11. Then, the sweep signal production unit 11 generates a frequency sweep signal which slowly sweeps the vicinities of the center of the input frequency. In other words, the sweep signal production unit 11 slowly varies the frequencies of the frequency sweep signal in the vicinity of the notch frequency or the peak frequency. The listener U listens to the frequency sweep signal and operates the input unit 18 so that the sound volume is kept constant.

The input unit 18, for example, is provided with a lever and a dial for adjusting the sound volume. The sound volume of sound output from the headphones 19 can be adjusted by the listener U operating the input unit 18. The setting storage unit 17 stores the sound volume adjusted by the listener U. The input unit 18 receives the operation of adjusting the sound volume by the listener U when frequencies are swept in the vicinity of frequencies stored in the setting storage unit 17.

The setting storage unit 17 stores the sound volume associated with the frequency. In other words, a frequency of a peak or a dip is associated with the sound volume adjusted at the frequency. The filter coefficient calculation unit 16 calculates a filter coefficient based on the frequency and the sound volume stored in the setting storage unit 17. The filter coefficient calculation unit 16 calculates a filter coefficient in real time using the already determined frequency and sound volume.

The filter coefficient calculated in real time by the filter coefficient calculation unit 16 is set to the variable filter unit 15. This changes the characteristic of the variable filter which is flat in an initial state. The filter coefficient calculation unit 16 multiplies the frequency sweep signal subjected to the out-of-head localization processing by the filter coefficient. Thus, the frequency sweep signal subjected to the out-of-head localization processing varies in peak level.

When the listener U determines that the frequency sweep signal auditorily reaches a certain level by the operation of the sound volume, the listener U operates the input unit 18. For example, when the frequency sweep signal reaches a certain level, the listener U presses an adjustment completion button. This determines the peak level at which the sound volume is kept constant. The setting storage unit 17 stores the filter coefficient and sound volume as level information at the time of pressing the adjustment completion button. The filter coefficient calculation unit 16 calculates the latest filter coefficient according to the level information. The filter coefficient calculation unit 16 calculates the filter coefficient based on the level information at the time of adjusting sound volume to keep it constant in the vicinity of the frequency stored in the setting storage unit 17.

The latest filter coefficient calculated from the frequency and the level information is set to the variable filter unit 15. Thus, measurement for eliminating resonance due to individual characteristics is completed. When the measurement is completed, input to the out-of-head localization unit 13 is switched from the sweep signal to the music signal. This leads to a normal music reproduction mode to enable a sound field reproduction using music signals. That is, the out-of-head localization unit 13 subjects music signals to the out-of-head localization processing and the variable filter unit 15 subjects music signals to the filter processing.

The out-of-head localization unit 13 subjects music signals to convolution using an ear canal correction function. The variable filter unit 15 subjects the music signals subjected to the convolution to filter processing by the filter coefficient set by using the frequency sweep signal and outputs the signals to the headphones 19. During the music reproduction, the AGC processing unit 14 does not perform the AGC processing. At the time of measurement using the frequency sweep signal, the out-of-head localization unit 13 does not need subjecting the frequency sweep signals to convolution processing.

Thus, the listener U is had listen to the frequency sweep signal to identify the peak frequency or the dip frequency. Thus, resonance according to the individual characteristics of the listener U can be eliminated. Furthermore, a filter coefficient for compensating the peak or dip occurred in a measurement environment is set. Thus, a sound field can be adequately reproduced.

Figure 3:
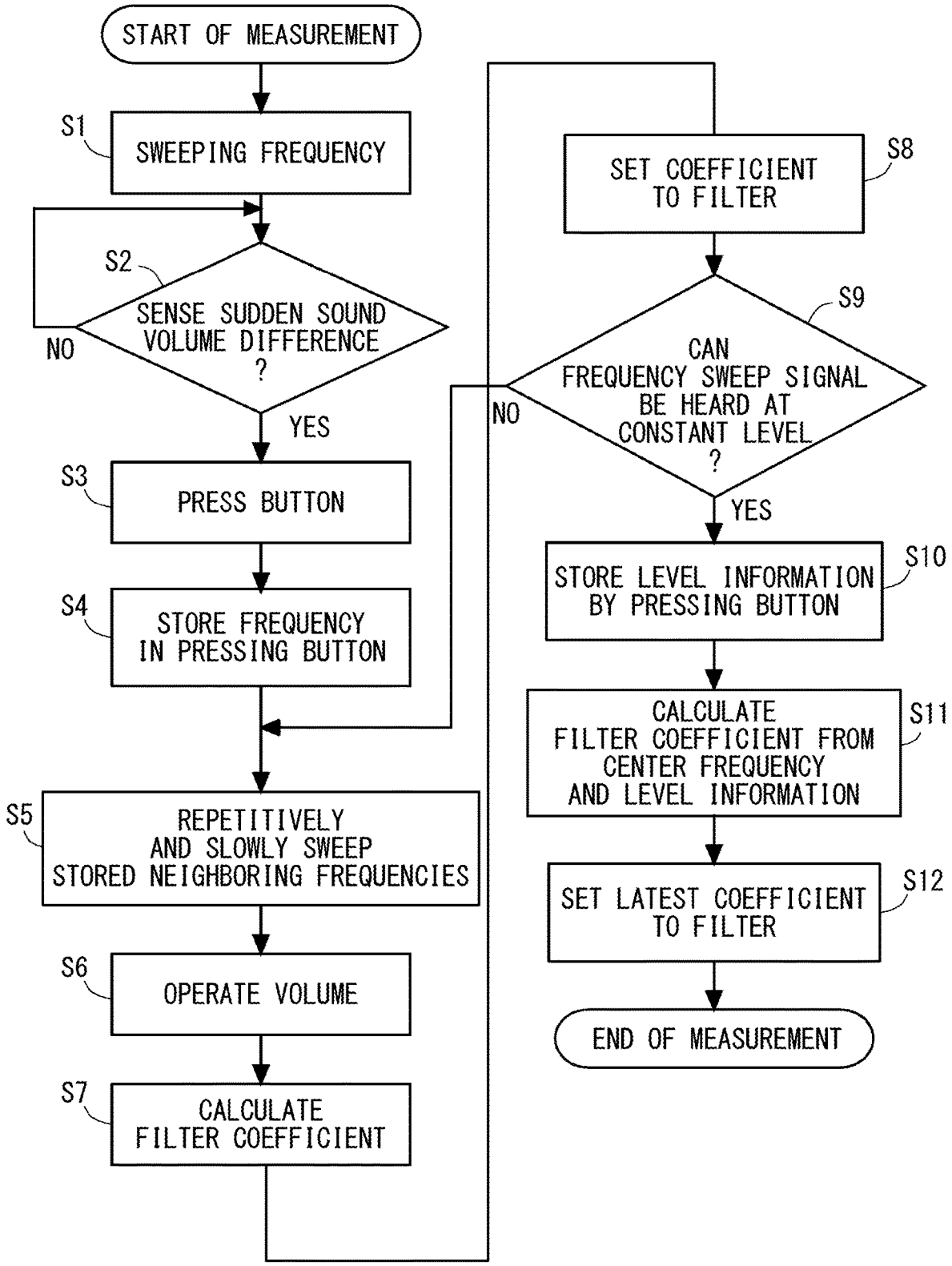
FIG. 3 is a flowchart showing a sound field reproduction method according to the first embodiment.

Sound quality adjustment in the sound field reproduction method according to the present embodiment is described below with reference to FIGS. 3 to 7. FIG. 3 is a flowchart showing the sound quality adjustment in the sound field reproduction method. FIGS. 4 to 7 are graphs illustrating variations of the frequency characteristics in the adjustment operation. In the FIGS. 4 to 7, each abscissa represents frequency and each ordinate shows sound volume received by the listener U.

Figure 4:
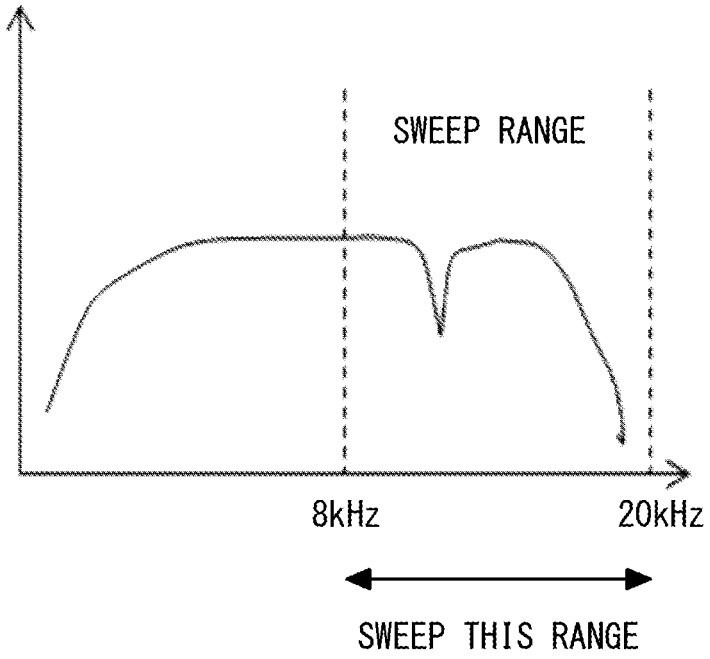
FIG. 4 is a graph for describing a sweep operation and change in frequency characteristic.

When measurement is started, the frequency of the frequency sweep signal is swept to find out a center frequency of peak and dip (S1). The sweep signal production unit 11 sweeps the sweep range from 8 kHz to 20 kHz as shown in FIG. 4. Here, only higher frequencies to which the listener U can listen are swept. It is determined as to whether the listener U senses a sudden sound volume difference while listening to the frequency sweep signal (S2). That is to say, it is determined as to whether the listener U senses a sound volume difference in the frequency sweep signal output at a constant level. If the listener U does not sense a sudden sound volume difference (NO in S2), frequencies are continuously swept.

Figure 5:
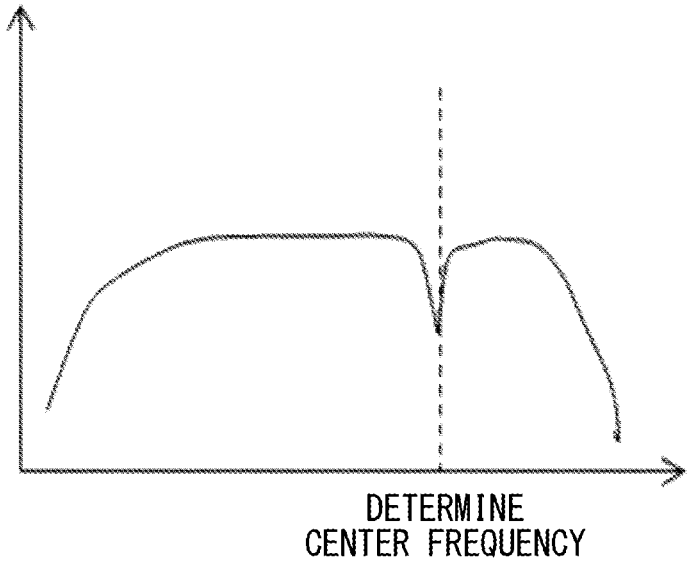
FIG. 5 is a graph for describing a sweep operation and change in frequency characteristic.

If the listener U senses a sudden sound volume difference (YES in S2), the listener U presses the frequency determination button in the input unit 18 (S3). In other words, the listener U presses the frequency determination button at a timing when the sound volume reaches maximum or minimum. Then, the setting storage unit 17 stores frequencies at the time of pressing the frequency determination button (S4). As shown in FIG. 5, the frequency at the time of pressing the frequency determination button is determined as a center frequency of the peak or the dip.

Figure 6:
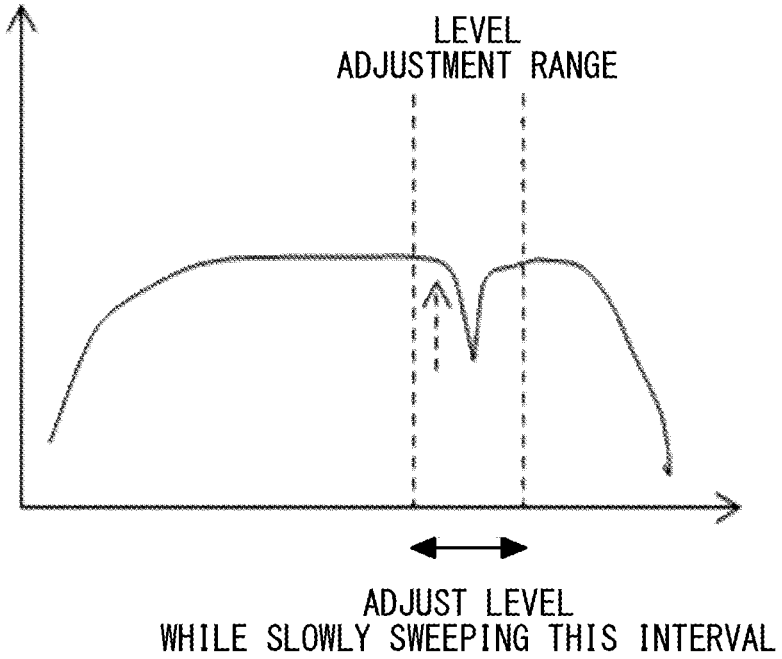
FIG. 6 is a graph for describing a sweep operation and change in frequency characteristic.

Neighboring stored frequencies are repetitively and slowly swept (S5). That is, as shown in FIG. 6, the vicinity of the stored frequencies is taken as the level adjustment range. The sweep signal production unit 11 outputs the frequency sweep signal which sweeps the level adjustment range including the center frequency. A sweep speed in the level adjustment range is slower than the sweep speed in S1. In other words, the sweep signal production unit 11 sweeps the level adjustment range slower than the sweep range. Thus, a part of the sweep range of 8 to 20 kHz is extracted as the level adjustment range and the range is slowly swept.

While the level adjustment range is slowly being swept, the listener U operates the sound volume (S6). In a frequency with the dip, the sound volume audible to the listener U reduces. Therefore, as shown in FIG. 6, the listener U increases the sound volume to make an audible sound volume constant. To the contrary, if the frequency characteristic has a peak, the listener U lowers the sound volume at the center frequency to keep the sound volume constant. The listener U adjusts the sound volume level while listening to the frequency sweep signal. Thus, the sound volume to which the listener U listens can be adjusted at the center frequency.

The setting storage unit 17 stores the operated sound volume and the filter coefficient calculation unit 16 calculates a filter coefficient based on the stored sound volume and frequency (S7). The filter coefficient calculated in real time is set to the variable filter unit 15 (S8). Thus, the characteristic of the filter is changed. That is, the filter coefficient in the peak frequency or the notch frequency is changed. The variable filter unit 15 subjects the frequency sweep signal to the filter processing and outputs the signal to the headphones 19. In other words, the variable filter unit 15 outputs the frequency sweep signal multiplied by the filter coefficient to the headphones 19.

The headphones 19 output the frequency sweep signal subjected to the filter processing to the listener U. The listener U determines as to whether the frequency sweep signal output from the headphones 19 can be heard at a constant level (S9). That is, when sweeping is performed in the level adjustment range shown in FIG. 6, the listener U determines as to whether the sound volume is kept constant irrespective of frequencies.

Figure 7:
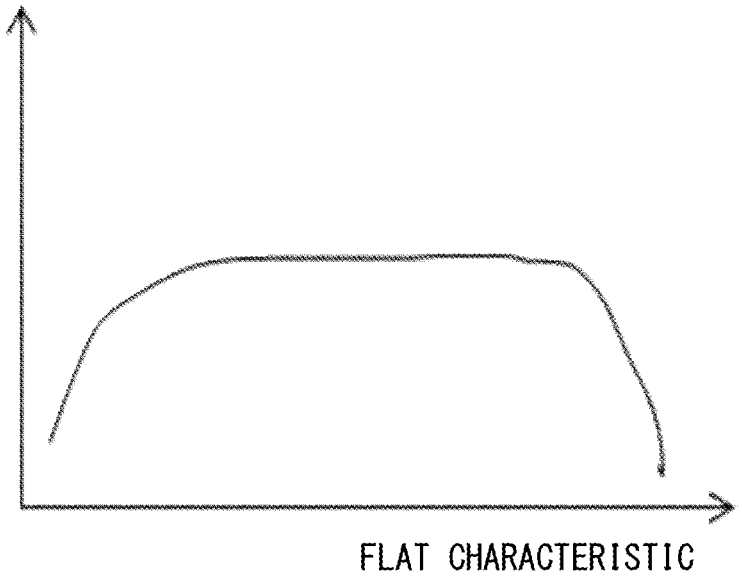
FIG. 7 is a graph for describing a sweep operation and change in frequency characteristic.

If the listener U determines that the frequency sweep signal cannot be heard at a constant level (NO in S9), the processing from step S5 is repeated until the frequency sweep signal can be heard at a constant level. That is, the listener U adjusts the sound volume while listening to the sweep signal in the level adjustment range. For this reason, as shown in FIG. 7, the processing from S5 to S9 is repeated until the frequency sweep signal can be heard at a constant level. If the listener U determines that the frequency sweep signal can be heard at a constant level (YES in S9), the listener U depresses the adjustment completion button. Thus, the setting storage unit 17 stores the sound volume and the filter coefficient in pressing the adjustment completion button as level information (S10). Thus, as shown in FIG. 7, the frequency sweep signal can be heard at a nearly constant sound volume irrespective of frequencies.

As shown in FIG. 7, when the sound volume becomes constant, the filter coefficient calculation unit 16 calculates the latest filter coefficient from the center frequency and the level information (S11). That is to say, the setting storage unit 17 stores the level information according to the sound volume at the time of the sound volume kept constant in the level adjustment range, associated with the frequencies. The filter coefficient calculation unit 16 calculates the latest filter coefficient at the frequency based on the frequency and the level information stored in the setting storage unit 17. Thereafter, the latest filter coefficient is set to the variable filter unit 15 (S12). Thus, the measurement of the filter coefficient is ended.

The latest filter coefficient is set to the variable filter unit 15 during a music reproduction. When music signal is reproduced, the out-of-head localization unit 13 subjects the music signal to the out-of-head localization processing and the variable filter unit 15 subjects the music signal to the filter processing. That is, the music signal is multiplied by the filter coefficient included in the filter set to the variable filter unit 15. The headphones 19 output the music signal subjected to the filter processing to the listener U. That is, the headphones 19 output the music signal subjected to the out-of-head localization processing and the filter processing to the listener U to reproduce the sound field.

Thus, the filter coefficient is obtained by the measurement using the sweep signal. Performing the filter processing using the filter including the obtained filter coefficient enables resonance resulting in individual characteristics of the ear canal contour to be eliminated. For this reason, the music signal subjected to the out-of-head localization processing can be appropriately corrected. Therefore, even if the headphones 19 are used, the sound field can be appropriately reproduced. In the above description, the sound field reproduction device using the headphones 19 is shown; however, a sound field reproduction device using earphones may also be used for processing as well.

In the above, a case where the dip lies in the frequency characteristic is described; however, even in a case where the peak lies therein, the sound quality can also be adjusted. That is, the sound volume may be lowered in S6, in the same manner that the sound volume is lowered in the peak frequency. This enables the sound quality to be adjusted in the same manner that the sound volume is lowered in the peak frequency.

If two or more peak and dip frequencies exist, the sound volumes for respective frequencies may be adjusted. That is, the sound volume for respective peaks and dips included in the sweep range is adjusted. The filter coefficient calculation unit 16 acquires the filter coefficient according to the level information at the time of performing the sound volume adjustment and the frequency corresponding to the level information. This allows a suitable filter to be set, which enables a suitable sound field to be reproduced. Alternatively, the frequency band width of the notch filter or the peaking filter may be adjusted.

Displaying the frequency shown in the display unit allows the listener U to be easily understandable. It may have the listener U adjust the speed for the frequency sweep signal production unit 11 sweeping frequencies.

SECOND EMBODIMENT

Figure 8:
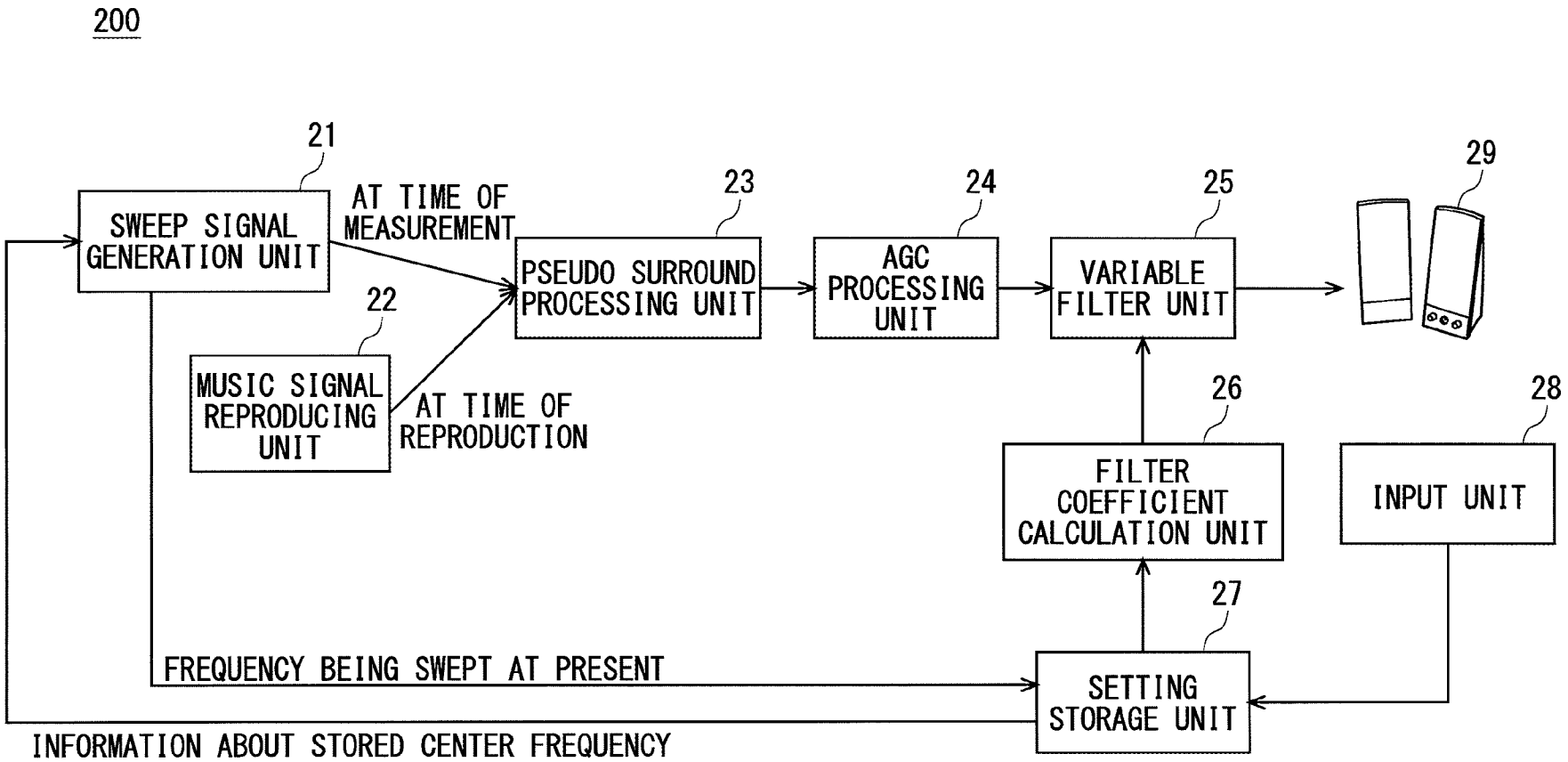
FIG. 8 is a block diagram showing a sound field reproduction device according to a second embodiment.

A sound field reproduction device according to the present embodiment is described with reference to FIG. 8. FIG. 8 is a block diagram showing a sound field reproduction device 200 according to a second embodiment. In the present embodiment, the sound field is reproduced by using not the headphones 19 but a speaker 29. In other words, the speaker 29 is used instead of the headphones 19.

The speaker 29 is a speaker that has a plurality of channels such as a stereo speaker, a surround speaker. In the present embodiment, a pseudo surround processing unit 23 is provided instead of the out-of-head localization unit 13 in the first embodiment. The configuration excluding the pseudo surround processing unit 23 is similar to that in the first embodiment, so that description thereof is omitted.

A sweep signal generated in a sweep signal production unit 21 and a music signal reproduced in a music signal reproducing unit 22 are input to the pseudo surround processing unit 23. A previously measured head related transfer characteristic (also referred to as a head related transfer function) is set to the pseudo surround processing unit 23. The pseudo surround processing unit 23 subjects the head related transfer characteristic (also referred to as a head related transfer function) to the convolution processing. The pseudo surround processing unit 23 outputs the frequency sweep signal subjected to the convolution processing to an AGC processing unit 24. Each processing in the AGC processing unit 24, a variable filter unit 25, a filter coefficient calculation unit 26, a setting storage unit 27, and an input unit 28 is similar to the processing in the AGC processing unit 14, the variable filter unit 15, the filter coefficient calculation unit 16, the setting storage unit 17, and the input unit 18 in the first embodiment. Accordingly, as is the case with the first embodiment, the frequency of the notch or the peak is determined and the filter coefficient calculation unit 26 calculates a filter coefficient.

A filter having the calculated filter coefficient is set to the variable filter unit 25. The speaker 29 outputs the frequency sweep signal multiplied by the filter coefficient to a listener U. As is the case with the first embodiment, the listener U adjusts the sound volume while listening to the frequency sweep signal output by the speaker 29. The latest filter coefficient is calculated, thereafter, an input to the pseudo surround processing unit 23 is switched from the frequency sweep signal to a music signal. The pseudo surround processing unit 23 and the variable filter unit 25 subject the music signal to the processing. The music signal subjected the processing by the pseudo surround processing unit 23 and the variable filter unit 25 is output from the speaker 29.

In the present embodiment, the pseudo surround processing unit 23 convolutes the head related transfer characteristic to the music signal, thereafter, the variable filter unit 15 subjects the music signal to the filter processing. This enables the surround sound field output from the speaker 29 to be reproduced. Furthermore, a filter coefficient for correcting the peak or the dip occurring due to a measurement environment is set. Therefore, the sound field can be appropriately reproduced.

THIRD EMBODIMENT

In the present embodiment, the transfer characteristic of an individual is measured and the sound field reproduction such as the out-of-head localization is realized by using the filter according to the transfer characteristic.

Furthermore, in the present embodiment, a high resolution digital audio signal (hereinafter referred to as an HR signal) is subjected to an out-of-head localization processing. In the following description, a signal picked up by a sampling frequency of 96 kHz is described by an HR signal. On the other hand, a signal stored by a sampling frequency of 48 kHz (a low resolution signal) is taken as a non high resolution signal (non-HR signal). Needless to say, the sampling frequency is not restricted to the above values.

In a case where a sampling frequency of 48 kHz is taken as a non-HR signal, a Nyquist frequency will be 24 kHz. The following description is made with a band less than 24 kHz as a low frequency band, and a band equal to or higher than 24 kHz as a high frequency band. A first frequency showing a boundary between the high and low frequency bands is a Nyquist frequency of 24 kHz. Needless to say, the first frequency may be different from a frequency of 24 kHz. For example, the first frequency may be changed according to the sampling frequency.

Figure 9:
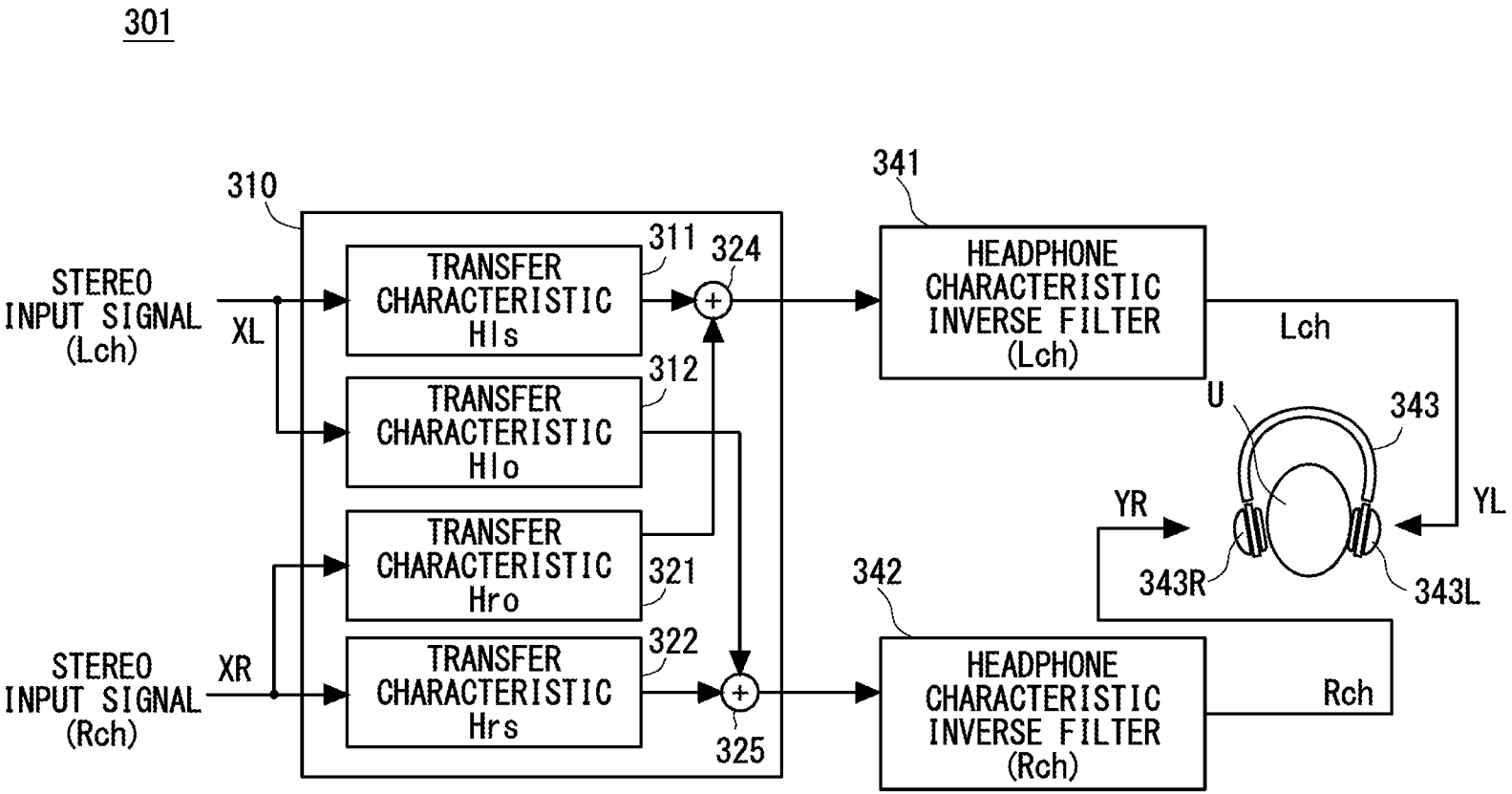
FIG. 9 is block diagram showing an out-of-head localization device in a third embodiment.

The configuration of an out-of-head localization device 301 for performing the out-of-head localization processing is described with reference to FIG. 9. FIG. 9 is a block diagram showing the configuration of the out-of-head localization device 301 being an example of the sound field reproduction apparatus. The out-of-head localization device 301 includes the out-of-head localization unit 13 in the first embodiment.

The out-of-head localization device 301 reproduces a sound field to a listener (user) U wearing a headphone 343. Therefore, the out-of-head localization device 301 performs sound localization about stereo input signals XL and XR of Lch and Rch. The stereo input signals XL and XR of Lch and Rch are audio reproduction signals outputted from audio apparatuses and the like corresponding to an HR signal. Also, the out-of-head localization device 301 is not limited to a physically single device, and a part of a process may be performed with a different device. For example, a part of the process may be performed with a personal computer and the like, and the rest process may be performed with a DSP (Digital Signal Processor) and the like built in the headphone 343.

The out-of-head localization device 301 is equipped with a transfer characteristic processing unit 310, a filter unit 341, a filter unit 342, and the headphone 343.

The transfer characteristic processing unit 310 performs a filter processing according to transfer characteristics. The transfer characteristic processing unit 310 is equipped with convolution computing units 311 to 312 and 321 to 322, and adders 324 and 325. The convolution computing units 311 to 312 and 321 to 322 perform a convolution process using spatial acoustic transfer characteristics. In the transfer characteristic processing unit 310, the stereo input signals XL and XR from the audio apparatus and the like corresponding to the HR signal are inputted. In the transfer characteristic processing unit 310, the spatial acoustic transfer characteristics are set. The transfer characteristic processing unit 310 convolutes the spatial acoustic transfer characteristics to the stereo input signals XL and XR of each ch.

The spatial acoustic transfer characteristics have four transfer characteristics Hls, Hlo, Hro, and Hrs. The four transfer characteristics can be obtained using a filter generation device mentioned below.

Then, the convolution computing unit 311 convolutes the transfer characteristic Hls with respect to the stereo input signal XL of Lch. The convolution computing unit 311 outputs convolution computing date to the adder 324. The convolution computing unit 321 convolutes the transfer characteristic Hro with respect to the stereo input signal XR of Rch. The convolution computing unit 321 outputs convolution computing date to the adder 324. The adder 324 adds the two convolution computing data to output the data to the filter unit 341.

The convolution computing unit 312 convolutes the transfer characteristic Hlo with respect to the stereo input signal XL of Lch. The convolution computing unit 312 outputs the convolution computing data to the adder 325. The convolution computing unit 322 convolutes the transfer characteristic Hrs with respect to the stereo input signal XR of Rch. The convolution computing unit 322 outputs convolution computing date to the adder 325. The adder 325 adds the two convolution computing data to output the data to the filter unit 342. In this way, the transfer characteristic processing unit 310 performs the convolution process by using the filters corresponding to the transfer characteristics Hls, Hlo, Hro, and Hrs.

In the filter units 341 and 342, inverse filters for cancelling ear canal transfer characteristics are set. Then, the inverse filter is convoluted in a reproduction signal subjected to the process in the transfer characteristic processing unit 310. The inverse filter is convoluted with the filter unit 341 with respect to the Lch signal from the adder 324. In the same way, the filter unit 342 convolutes the inverse filter with respect to the Rch signal from the adder 325. The inverse filter, when wearing the headphone 343, cancels characteristics from a headphone unit to a microphone. Namely, it cancels the transfer characteristics between the ear canal inlet of each listener and the reproduction unit of the headphone, or between an eardrum and the reproduction unit of the headphone, when the microphone is disposed at an ear canal inlet.

The filter unit 341 outputs the corrected Lch signal to a left unit 343L of the headphone 343. The filter unit 342 outputs the corrected Rch signal to a right unit 343R of the headphone 343. The listener U wears the headphone 343. The headphone 343 outputs the Lch signal and the Rch signal toward the listener U. Therefore, a sound image localized outside the head of the listener U can be reproduced.

It is preferable to measure the transfer characteristics Hls, Hlo, Hro, and Hrs according to the actual listener U. For example, the microphones are put on ears of the listener U to perform impulse response measurement, and thus the transfer characteristics Hls, Hlo, Hro, and Hrs according to an auricular shape of the listener U can be obtained. In this way, by using the transfer characteristics Hls, Hlo, Hro, and Hrs which are obtained by actually putting the microphones on the ears of the listener U, an out-of-head localization process can be properly performed.

Here, a case that the out-of-head localization process is performed on the HR signal will be described. In order to obtain the HR signal, it is necessary to prepare a microphone corresponding to the HR signal. Usually, although an audio band is said to be 20 Hz to 20 kHz, so as to correspond to the HR signal, it is necessary to prepare an HR signal corresponding microphone capable of collecting high frequency sound of 20 kHz or more. The HR signal corresponding microphone has sensitivity to a high frequency band and there is a problem in miniaturization.

For example, a diameter of an ear canal inlet of human is about 7.5 mm, whereas that of a realistically available HR signal corresponding microphone is about 1.5 cm. It is impossible to obtain the HR signal corresponding microphone small enough to be put on near the ear canal inlet of human cannot usually be obtained. Also, even if the HR signal corresponding microphone sized to be put on near the ear canal inlet of human exists, it will be considered to be very expensive. Therefore, it is unrealistic to put the HR signal corresponding microphone for each listener U. Then, in this embodiment, in a low frequency band, the microphone measures an amplitude value of the transfer characteristic, and in a high frequency band, the filter generation device generates the amplitude value of the transfer characteristic.

Figure 10:
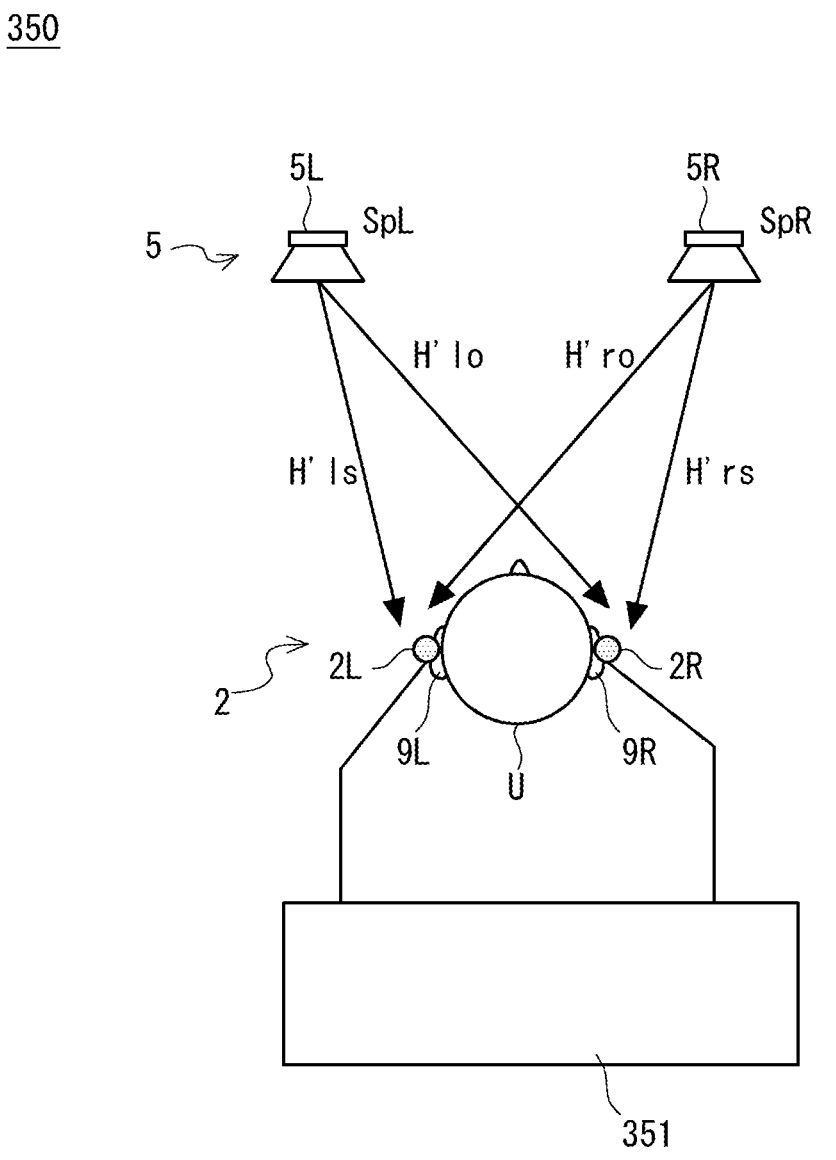
FIG. 10 illustrates a configuration of a filter generation device for generating a filter according to a transfer characteristic in the third embodiment.

Hereinafter, the constitution of the filter generation device 350 will be described using FIG. 10. The filter generation device 350 is equipped with left and right speakers 5L and 5R that are sound sources, and left and right microphones 2L and 2R, and a processing unit 351. As shown in FIG. 10, impulse sound outputted from the left and right speakers 5L and 6R is measured by the microphones 2L and 2R, thereby measuring impulse response. A sound pickup signal obtained by the microphones 2L and 2R is outputted to the processing unit 351. The processing unit 351, for example, is a computing process device such as a personal computer. The processing unit 351, based on the sound pickup signal, functions as a filter generation unit for generating a filter. Details of a process in the processing unit 351 will be described below.

In FIG. 10, transfer characteristics measured by the microphones 2L and 2R are indicated as transfer characteristics H'ls, H'lo, H'ro, and H'rs. The transfer characteristic H'ls between the left speaker 5L and the left microphone 2L, H'lo between the left speaker 5L and the right microphone 2R, the transfer characteristic H'ro between the right speaker 5R and the left microphone 2L, and H'rs between the right speaker 5R and the right microphone 2R are measured. That is, by picking up a measurement signal outputted from the left speaker 5L with the left microphone 2L, the transfer characteristic H'ls is obtained. By picking up a measurement signal outputted from the left speaker 5L with the right microphone 2R, the transfer characteristic H'lo is obtained. By picking up a measurement signal outputted from the right speaker 5R with the left microphone 2L, the transfer characteristic H'ro is obtained. By picking up a measurement signal outputted from the right speaker 5R with the right microphone 2R, the transfer characteristic H'rs is obtained.

As described above, by measuring the impulse sound outputted from the left and right speakers 5L and 5R with the microphones 2L and 2R, the impulse response is measured. The processing unit 351 stores the sound pickup signal obtained based on the impulse response measurement in a memory and the like. Therefore, the transfer characteristic H'ls between the left speaker 5L and the left microphone 2L, the transfer characteristic H'lo between the left speaker 5L and the right microphone 2R, the transfer characteristic H'ro between the right speaker 5R and the left microphone 2L, and the transfer characteristic H'rs between the right speaker 5R and the right microphone 2R are measured. That is, by picking up a measurement signal outputted from the left speaker 5L with the left microphone 2L, the transfer characteristic H'ls is obtained. By picking up a measurement signal outputted from the left speaker 5L with the right microphone 2R, the transfer characteristic H'lo is obtained. By picking up a measurement signal outputted from the right speaker 5R with the left microphone 2L, the transfer characteristic H'ro is obtained. By picking up a measurement signal outputted from the right speaker 5R with the right microphone 2R, the transfer characteristic H'rs is obtained.

As described above, since it is difficult to miniaturize the HR signal corresponding microphone, the microphones 2L and 2R are the microphones which do not correspond to the HR signal. That is, the sound pickup signal obtained by the microphones 2L and 2R are non-HR signals. Therefore, the left and right speakers 5L and 5R can also be the speaker which does not correspond to the HR signal. A sampling frequency of the sound pickup signal is 48 kHz.

The sound pickup signal is a non-HR signal, and the transfer characteristic does not include a component in a high frequency band of 24 kHz or more. On the other hand, the actual stereo input signals XL and XR of an out-of-head localization process include a component in the high frequency band. Therefore, in this embodiment, the processing unit 351 calculates the transfer characteristic in the high frequency band.

Figure 11:
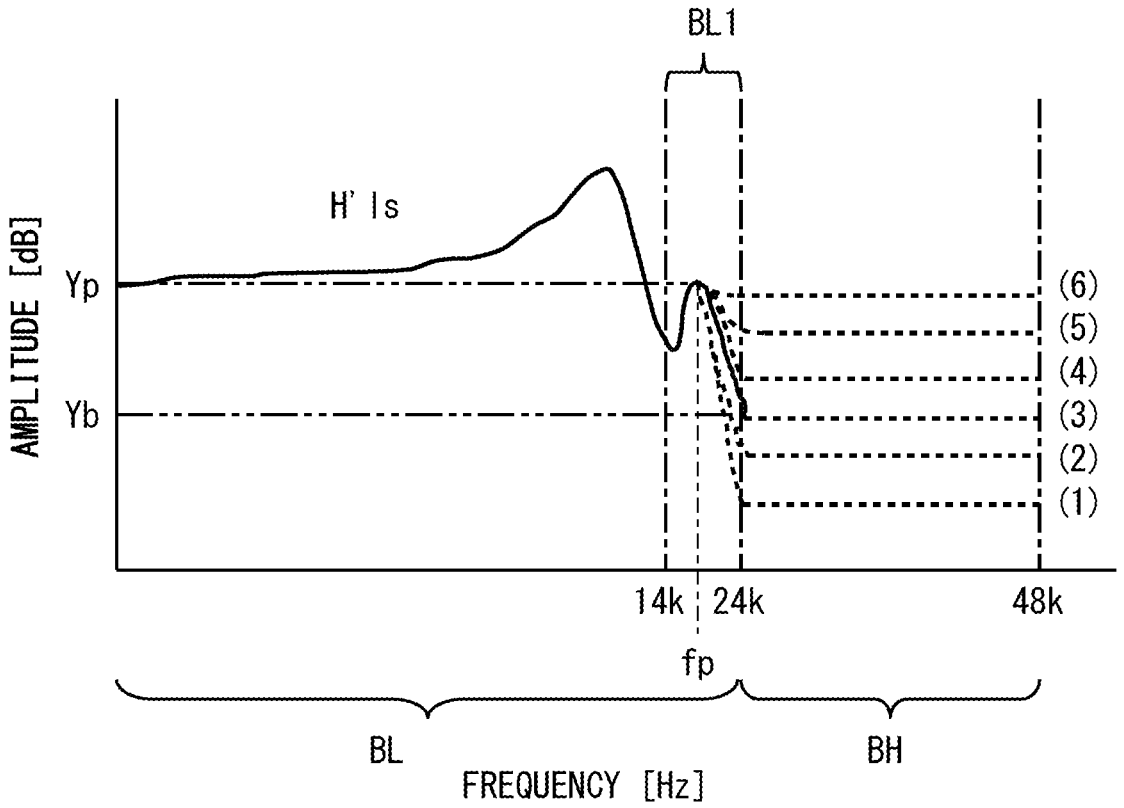
FIG. 11 illustrates a transfer characteristic HIs in a frequency range.

A method of calculating the transfer characteristic in the high frequency band will be described using FIG. 11. FIG. 11 indicates the transfer characteristic Hls in a frequency domain. A horizontal axis is a frequency (Hz), and a vertical axis is amplitude (dB) of the transfer characteristic Hls. That is, FIG. 11 indicates frequency amplitude characteristic of the transfer characteristic Hls. Also, in FIG. 11, the transfer characteristic H'ls by the measured sound pickup signal is indicated by a solid line. Discrete Fourier transform is performed on the pickup signal in a time domain, thereby obtaining the transfer characteristic H'ls in the frequency domain.

In FIG. 11, a band including a frequency that is a first frequency (a Nyquist frequency=24 kHz) or more is indicated as a high frequency band BH, and a band including a frequency lower than the first frequency is indicated as a low frequency band BL. Also, 14 kHz is indicated as a second frequency, and a band from the second frequency to the first frequency is indicated as an interpolation band BL1. The second frequency may be a frequency lower than the Nyquist frequency, and is not limited to 14 kHz. The second frequency is preferably a frequency of 10 kHz or more.

Here, an amplitude value of the transfer characteristic H'ls in the first frequency (24 kHz) is made to be an amplitude value Yb[dB]. The processing unit 351 obtains a peak of the transfer characteristic H'ls in the interpolation band BL1. Here, the peak frequency and the amplitude value are made to be a frequency fp[Hz] and an amplitude value Yp[dB]. Also, when a plurality of peaks exists in the interpolation band BL1, the peak frequency of the highest frequency and the amplitude value are set as the frequency fp and the amplitude value Yp. Also, when no peak exists in the interpolation band BL1, the processing unit 351 sets the second frequency and the amplitude value as the frequency fp and the amplitude value Yp. The frequency fp is 14 kHz or more, and less than 24 kHz. The amplitude value Yp is also referred to as a second amplitude value.

Then, for bands 0 to fp, the processing unit 351 sets the amplitude value of the transfer characteristic H'ls as the amplitude value of the transfer characteristic Hls as it is. Therefore, the amplitude value of the transfer characteristic Hls at the frequency fp becomes the amplitude value Yp. Also, for bands of fp to 48 kHz, the processing unit 351 calculates the amplitude value based on the amplitude value Yp. Hereinafter, the way of obtaining the amplitude value in the bands of fp to 48 kHz will be described.

Here, the processing unit 351 calculates six frequency amplitude characteristics (1) to (6). In the frequency amplitude characteristic (3), the amplitude value (also referred to as a first amplitude value) of the transfer characteristic Hls at 24 kHz is the amplitude value Yb. The amplitude value of the transfer characteristic Hls in the high frequency band BH is constant at the amplitude value Yb. The amplitude value of the transfer characteristic Hls in the band of fp to 24 kHz is obtained by interpolating the amplitude value Yp and the amplitude value Yb. That is, the amplitude value of the transfer characteristic Hls at fp to 24 kHz is calculated so as to complement an interval between the amplitude value Yp and the first amplitude value. Here, by a publicly known method such as linear interpolation, the amplitude value of the transfer characteristic Hls at fp to 24 kHz is obtained. Alternatively, the amplitude value of the transfer characteristic Hls at fp to 24 kHz may be the measured amplitude value of the transfer characteristic H'ls.

The processing unit 351 changes the amplitude value (also referred to as the first amplitude value) of the transfer characteristic Hls at 24 kHz from the amplitude value Yb, thereby obtaining the rest frequency characteristics (1), (2), (4) to (6). For example, in the frequency amplitude characteristic (1), the first amplitude value is (Yb−6), in the frequency amplitude characteristic (2), the first amplitude value is (Yb−3), in the frequency amplitude characteristic (4), the first amplitude value is (Yb+3), in the frequency amplitude characteristic (5), the first amplitude value is (Yb+6), and in the frequency amplitude characteristic (6), the first amplitude value is (Yb+9). It is preferable that the first amplitude value is set in a range not exceeding the amplitude value Yp. For example, if (Yb+9) exceeds Yp, it is not necessary to obtain the frequency amplitude characteristic (6).

Then, the amplitude value of the transfer characteristic Hls in the high frequency band BH is constant at the first amplitude value. For example, in the frequency amplitude characteristic (1), the amplitude value of the transfer characteristic Hls in the high frequency band BH is constant at the first amplitude value (Yb−6). In the frequency amplitude characteristic (2), the amplitude value of the transfer characteristic Hls in the high frequency band BH is constant at the first amplitude value (Yb−3). Concerning the frequency amplitude characteristics (4), (5), and (6), the amplitude values of the transfer characteristic Hls in the high frequency band BH are constant at the respective first amplitude values.

The amplitude value of the transfer characteristic Hls in the band of fp to 24 kHz is obtained by interpolating the amplitude value Yp and the first amplitude value. Here, the amplitude value of the transfer characteristic Hls at fp to 24 kHz is obtained by the publicly known method such as linear interpolation. In this way, by setting the first amplitude value in 3 dB increments, the frequency amplitude characteristics (1) to (6) are obtained. The frequency amplitude characteristics (1) to (6) respectively become candidates of the transfer characteristic Hls.

As described above, based on the measured transfer characteristic H'ls, the transfer characteristic Hls can be obtained. Also, the other transfer characteristics Hlo, Hrs, and Hro can be obtained based on the transfer characteristics H'lo, H'ro, and H'rs. Then, the transfer characteristics Hls, Hlo, Hrs, and Hro are respectively subjected to inverse discrete Fourier transform. By obtaining the four transfer characteristics Hls, Hlo, Hrs, and Hro in the time domain, the filter is generated. Here, one filter includes the four transfer characteristics Hls, Hlo, Hrs, and Hro in the time domain.

Also, in the above description, the frequency amplitude characteristics (1) to (6) are obtained about the respective transfer characteristics Hls, Hlo, Hrs, and Hro. That is, six filters are generated. Then, by performing an auditory test, the optimum filter (the transfer characteristics Hls, Hlo, Hrs, and Hro) is obtained from the plurality of filters. The auditory test will be described later. The optimum filter (the transfer characteristics Hls, Hlo, Hrs, and Hro) obtained by the auditory test is set in the convolution computing units 311 to 312 and 321 to 322 shown in FIG. 9, and the out-of-head localization process is performed.

In this way, the processing unit 351 sets the amplitude component in the low frequency band BL of the filter according to the frequency amplitude characteristics of the sound pickup signal, and generates the amplitude component in the high frequency band BH of the filter so as to connect to the amplitude component in the low frequency band. Thereby, the filter corresponding to the HR signal can be generated. Since the low frequency band BL can use the transfer characteristic of the listener U himself/herself, the out-of-head localization process can be properly performed. Also, the measurement of the transfer characteristics H'lo, H'ro, and H'rs can be performed with the microphones 2L and 2R not corresponding to the HR signal and the speakers 5L and 5R. The microphones 2L and 2R not corresponding to the HR signal has a small size and can be put on left and right ears. Therefore, it is possible to simply and easily perform the measurement.

The processing unit 351 sets the first amplitude value at the first frequency of the transfer characteristic, based on the amplitude value Yb of the frequency amplitude characteristic of the sound pickup signal at the first frequency (24 kHz). Therefore, the out-of-head localization process can be properly performed. Also, since a complicated process is not performed, it is possible to simply generate the filter.

The processing unit 351 sets a corrected value of the amplitude value Yb of the frequency amplitude characteristic of the sound pickup signal at the first frequency, as the first amplitude value. According to the description mentioned above, a value (for example, Yb−3 or Yb+3) obtained by level adjustment of the amplitude value Yb is set as the first amplitude value. Therefore, by a simple method, the out-of-head localization process can be performed. Also, since a complicated process is not performed, it is possible to simply generate the filter.

Also, in this embodiment, although a value obtained by changing Yb in 3 dB increments is set as the first amplitude value, the setting of the first amplitude value is not limited to such a method. For example, the first amplitude value may be set in 2 dB increments, and the first amplitude value may be set in increments other than a fixed increment. Also, the first amplitude value is set within a range not exceeding the amplitude value Yp. Therefore, the out-of-head localization process can be properly performed.

Also, according to the description mentioned above, although the amplitude value of the transfer characteristic Hls in the high frequency band BH is made to be a constant value, this embodiment is not limited to that. The amplitude value of the transfer characteristic Hls in the high frequency band BH may be gradually decreased or gradually increased with a constant inclination. Alternatively, according to patterns set in advance, the amplitude value of the transfer characteristic Hls in the high frequency band BH may be set.

Also, in the third embodiment, although the frequency amplitude characteristics (1) to (6) are obtained, a number of the frequency amplitude characteristics to be obtained may be one or more. If the number of the frequency amplitude characteristics is one, the auditory test becomes unnecessary. If the number of frequency amplitude characteristics is 2 or more, the auditory test described later is performed.

FIRST MODIFIED EXAMPLE

In the first modified example of the third embodiment, the frequency amplitude characteristic in the high frequency band is calculated according to simulation. Also, since other structures and methods are the same as those of the third embodiment, further explanation will be omitted.

Figure 12:
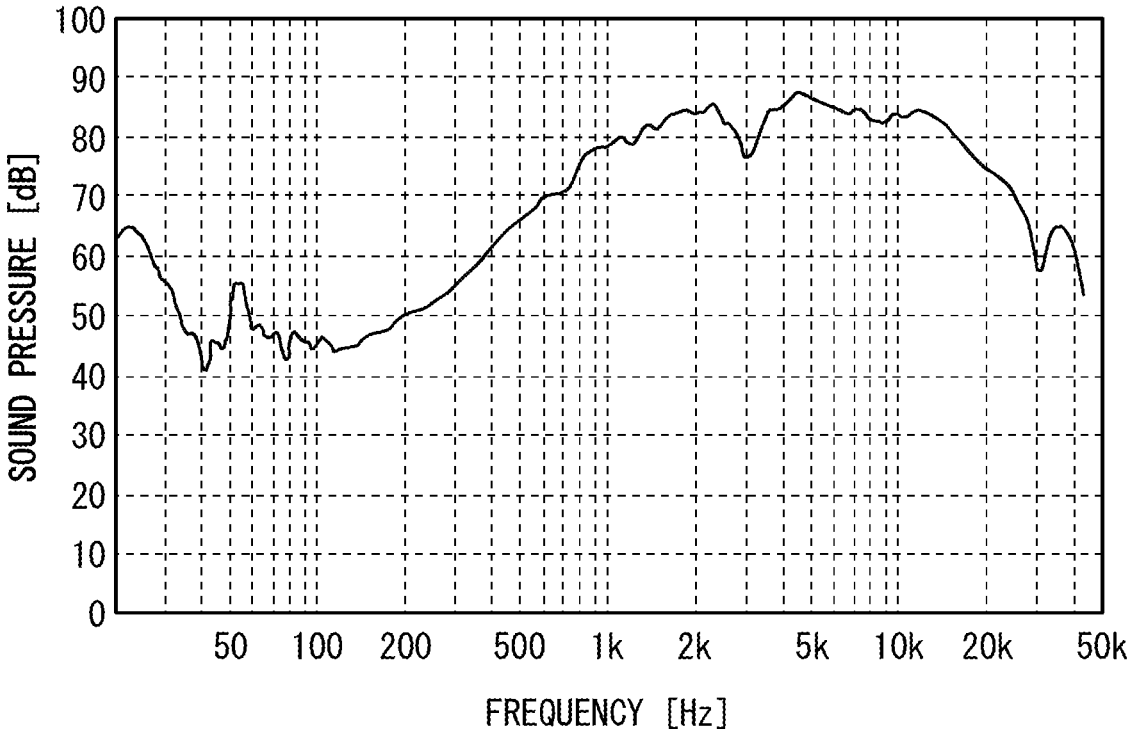
FIG. 12 illustrates a frequency characteristic of a speaker adapted to an HR signal.

FIG. 12 is a diagram illustrating the frequency amplitude characteristic of the HR signal corresponding speaker. A horizontal axis in FIG. 12 is frequency, and a vertical axis is sound pressure (dB). FIG. 12 illustrates the frequency characteristic when the HR signal corresponding speaker is disposed at an angle of 10 degrees from a front of the listener U.

Figure 13:
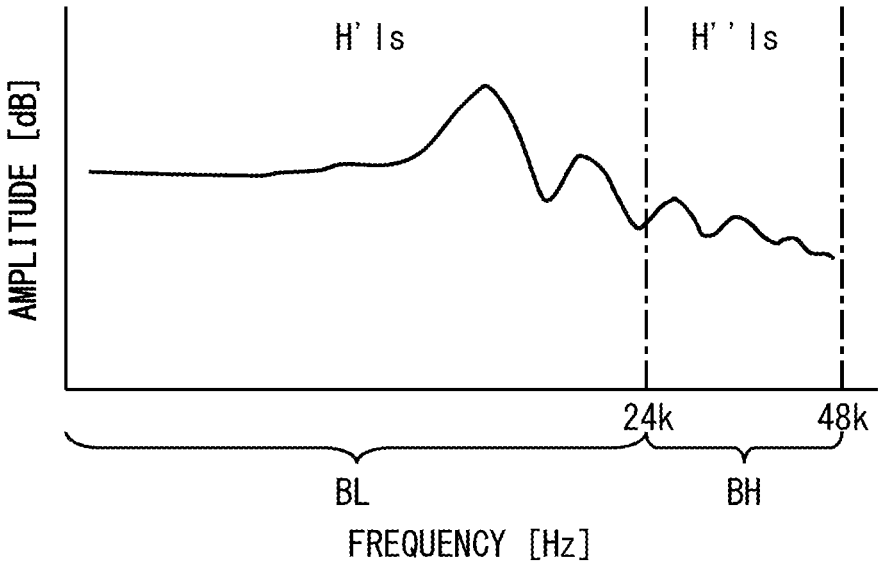
FIG. 13 is a graph showing the transfer characteristic HIs obtained by simulation.

FIG. 13 is a diagram illustrating the transfer characteristic Hls obtained from the frequency characteristic of FIG. 12. Specifically, FIG. 13 is a result of simulating the transfer characteristic Hls when the HR signal corresponding speaker is installed at the angle mentioned above. Such a simulation, for example, is described in "Acoustic Simulation Techniques for Personalized Three-Dimensional Auditory Reproduction" (http://www.nict.go.jp/publication/shuppan/kihou-journal/kihou-vol56no1_2/0403.pdf).

In the above document, FDTD (Finite-Difference Time Domain) method is used. By this method, for example, a head related transfer function HRTF of a dummy head with respect to a speaker arranged at a predetermined angle can be obtained. Therefore, it can be obtained by the transfer characteristic Hls from the speaker to the ear canal inlet. According to the simulation based on the frequency characteristic data of the speaker, the amplitude component in the high frequency band BH is estimated. Here, the transfer characteristic obtained by the simulation is made to be a transfer characteristic H"ls.

As the same as the first embodiment, the amplitude value in the low frequency band BL is the amplitude value of the measured transfer characteristic H'ls. As shown in FIG. 13, the transfer characteristic H'ls in the low frequency band BL and the transfer characteristic H"ls in the high frequency band BH are connected to generate the transfer characteristic Hls. That is, the processing unit 351 generates the transfer characteristic Hls so as to connect the amplitude component in the high frequency band to the amplitude component in the low frequency band.

SECOND MODIFIED EXAMPLE

In the second modified example of the third embodiment, the frequency amplitude characteristic in the high frequency band is measured by the HR signal corresponding microphone. Also, since other structures and methods are the same as those of the third embodiment, further explanation will be omitted.

Since it is considered that the HR signal corresponding microphone becomes very expensive as described above, it is difficult to measure by installing to each listener U. Therefore, by a person other than the listener U or the HR signal corresponding microphone installed to the dummy head, a representative transfer characteristic is measured. The measurement of the transfer characteristic using the HR signal corresponding microphone is the same as the structure shown in FIG. 10, and the microphones 2L and 2R are installed to the person other than the listener U or the dummy head.

The transfer characteristic measured by the HR signal corresponding microphone installed to the person other than the listener U or the dummy head is made to the transfer characteristic H"ls. For the high frequency band BH, the transfer characteristic H"ls is used, and for the low frequency band BL, the transfer characteristic H'ls measured by the HR signal non-corresponding microphone is used. Then, as the same as the first modified example, the transfer characteristic H'ls in the low frequency band BL and the transfer characteristic H"ls in the high frequency band BH are connected to generated the transfer characteristic Hls. That is, the processing unit 351 generates the transfer characteristic Hls so as to connect the amplitude component in the high frequency band to the amplitude component in the low frequency band.

In the first and second modified examples, the transfer characteristic H'ls in the low frequency band BL is obtained by measurement corresponding to the listener U. That is, as shown in FIG. 10, the transfer characteristic H'ls is measured by the HR signal non-corresponding microphone installed to the listener U. Therefore, since the filter corresponding to the listener U can be used, the out-of-head localization process can be properly performed.

In the first modified example, the transfer characteristic H"ls in the high frequency band BH is a simulation result. In the second modified example, the transfer characteristic H"ls in the high frequency band BH is measured by the HR signal corresponding microphone installed to the person other than the listener U or the dummy head. It is unnecessary to perform measurement by the very expensive HR signal corresponding microphone for each listener U. Therefore, the transfer characteristic corresponding to the HR signal can be simply obtained.

Figure 14:
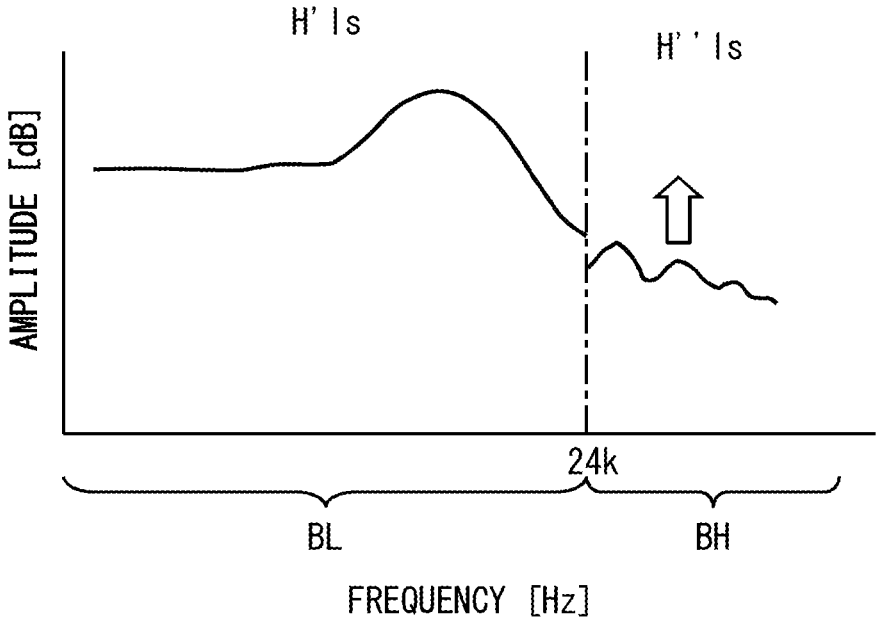
FIG. 14 is a graph for describing a processing for adjusting the level of components of a high frequency band.

In the first and second modified examples, as shown in FIG. 14, the amplitude value of the transfer characteristic may be greatly different in the vicinity of the first frequency (24 kHz). In such a case, there is a probability that the out-of-head localization process cannot be properly performed. Therefore, in the first and second modified examples, it is preferable to level adjust the transfer characteristic H"ls in the high frequency band BH (see an arrow in FIG. 14). Here, DC components in the high frequency band BH are increased and decreased, thereby vertically translating the amplitude characteristic.

In order to match the transfer characteristic H'ls in the low frequency band BL measured according to the listener U, the transfer characteristic H"ls in the high frequency BH is adjusted. Therefore, the out-of-head localization process can be properly performed. In this way, so as to connect the amplitude component in the high frequency band BH to the amplitude component in the low frequency band BL, the amplitude component in the high frequency band BH is level adjusted.

Figure 15:
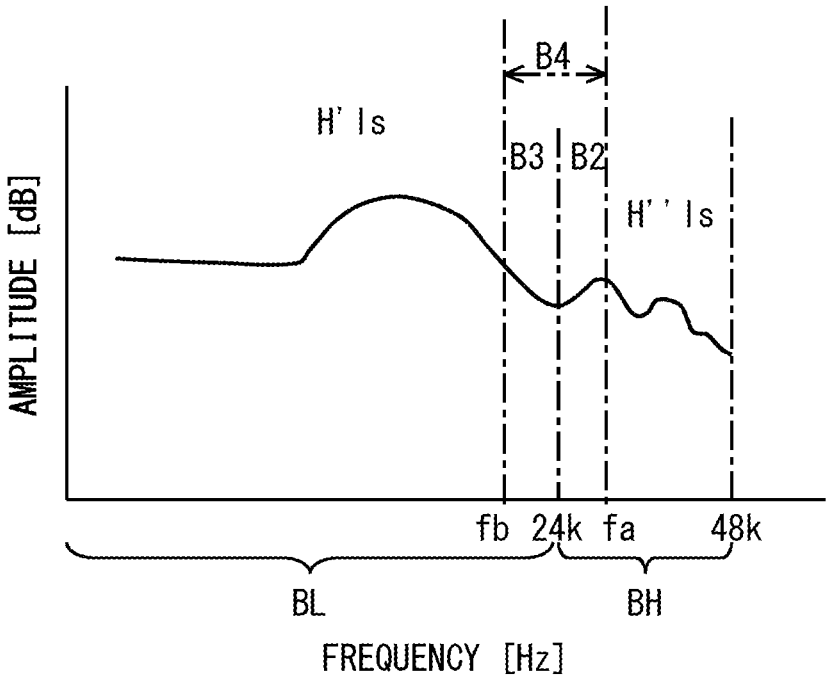
FIG. 15 is a graph for describing a process for smoothing an amplitude value.

Alternatively, a band which performs smoothing processing on the amplitude value may be provided at the vicinity of 24 kHz. The smoothing processing will be described using FIG. 15. In FIG. 15, a band disposed on the low frequency side in the high frequency band BH is made to be a band B2. A predetermined frequency included in the high frequency band BH is made to be a frequency fa. Also, the frequency fa is a frequency higher than 24 kHz. The band B2 is a range from 24 kHz to the frequency fa. In the band B2, the amplitude value is subjected to the smoothing processing.

Alternatively, in a band B3 instead of the band B2, the smoothing processing can be performed. The band B3 is a band disposed on the high frequency side in the low frequency band BL. For example, a predetermined frequency included in the low frequency band BL is made to be a frequency fb. The frequency fb is a frequency lower than 24 kHz. The Band B3 is a range from the frequency fb to 24 kHz. In the band B3, the amplitude value is subjected to the smoothing processing.

Alternatively, instead of the band B2 or the band B3, in a band B4 across 24 kHz, the smoothing processing may be performed. The band B4 is a range from the frequency fb to the frequency fa. In the band B4, the amplitude value is subjected to the smoothing processing. For the smoothing processing, a moving average or a weighted moving average can be used. By the smoothing processing, it is possible to generate a more appropriate filter in which the low frequency band and the high frequency band are smoothly continued.

As described above, in the first and second modified examples, the transfer characteristic H'ls in the low frequency band BL and the transfer characteristic H"ls in the high frequency band BH are connected to generate the transfer characteristic Hls. In the same way, the transfer characteristics Hlo, Hro, and Hrs are generated. Then, assuming the four transfer characteristics Hls, Hlo, Hro, and Hrs as one set, as the same as the first embodiment, inverse discrete Fourier transform is executed. Therefore, it is possible to generate a filter including the four transfer characteristics Hls, Hlo, Hro, and Hrs in the time domain as one set.

(Auditory Test)

The auditory test for deciding the optimum filter from a plurality of trial listening filters will be described. By performing the auditory test, an out-of-head localization reproduction can be performed with sound quality according to the preference of the listener U.

Here, the plurality of trial listening filters is generated by one or more methods of the third embodiment, and the first and second modified examples thereof. For example, in the third embodiment, since the frequency amplitude characteristics (1) to (6) are obtained, six filters are generated. Also, in the first modified example, by changing a simulation method or changing the frequency characteristic of the HR signal corresponding speaker used for the simulation, the plurality of filters can be generated. In the second modified example, by chancing the person wearing the HR signal corresponding microphone or the dummy head, the plurality of filters can be generated. These filters are used as the trial listening filters. Therefore, each of the plurality of trial listening filters is obtained by a method of any of the first embodiment, the first modified example, and the second modified example. Each of the trial listening filter includes the four transfer characteristics Hls, Hlo, Hro, and Hrs.

An out-of-head localization device 500 for performing the auditory test will be described using FIG. 16. The out-of-head localization device 500 is equipped with an adjustment signal production unit 521, a music signal reproduction unit 512, an out-of-head localization unit 302, a filter selection unit 522, a setting storage unit 517, an input unit 518, and a headphone 343.

Since the input unit 518 and the music signal reproduction unit 512 are respectively similar to the input unit 18 and the music signal reproduction unit 12 of FIG. 1, the detailed description is omitted. The headphone 343 is as the same as the headphone 343 of FIG. 10 and the headphone 19 of FIG. 1. However, the music signal reproduction unit 512 and the headphone 343 correspond to the HR signal. That is, the music signal reproduction unit 512 reproduces the HR signal picked up at a sampling frequency of 96 kHz as a music signal. The headphone 343 outputs the HR signal toward the listener U.

The adjustment signal production unit 521 outputs an adjustment signal for deciding the optimum filter to the out-of-head localization unit 302. That is, the adjustment signal production unit 521 outputs the HR signal picked up at the sampling frequency of 96 kHz as the adjustment signal. Also, the adjustment signal is a stereo signal including Lch and Rch. As the adjustment signal, it is preferable to use a sound source such as stringed instrument rich in harmonic. Specifically, by picking up the performance sound of cello, gamelan (ethnic music of Indonesia) and the like at the sampling frequency of 96 kHz, the adjustment signal is produced.

The out-of-head localization unit 302 is equipped with the transfer characteristic processing unit 310, the filter unit 341, and the filter unit 342 which are shown in FIG. 9. The stereo adjustment signal becomes the stereo input signals Lch and Rch of FIG. 9. Then, the out-of-head localization unit 302 outputs the adjustment signal which has been subjected to the out-of-head localization process to the headphone 343. The headphone 343 outputs the adjustment signal which has been subjected to the out-of-head localization process toward the listener U. Therefore, the auditory test is performed.

The listener U operates the input unit 518 according to auditory feeling of the adjustment signal which has been subjected to the out-of-head localization process. That is, the listener U inputs whether or not the proper out-of-head localization process is performed by the trial listening filter. Input by the input unit 518 is stored in the setting storage unit 517. The plurality of trial listening filters is stored in the filter selection unit 522. When the input of the auditory feeling to one filter is completed, the filter selection unit 522 switches the filter. That is, the filter selection unit 522 successively switches the trial listening filters to output the same to the he out-of-head localization unit 302. In this way, the auditory test is performed as many times as the number of the trial listening filters stored.

By operating the input unit 518, the listener U inputs the optimum filter indicating the most excellent auditory feeling. Then, the setting storage unit 517 stores the optimum filter. The optimum filter is set as a music reproduction filter. When reproducing a music signal, by using the optimum filter decided by the auditory test, the out-of-head localization unit 302 performs the out-of-head localization process. The listener U compares audibly using the adjustment signal corresponding to the HR signal and selects a favorite filter as the optimum filter. Then, the out-of-head localization process is performed using the optimum filter with respect to the music signal corresponding to the HR signal. Thus, the out-of-head localization process can be properly performed.

Also, the listener U operates the input unit 518 to switch the auditory test and the music reproduction. If the listener U inputs an instruction to perform the auditory test, the adjustment signal production unit produces the adjustment signal. After the finishing of the auditory test, if the listener U inputs an instruction to perform the music reproduction, the, music signal reproduction unit 512 reproduces the music signal. If there is only one set of the trial listening filter, the auditory test may not be performed.

Also, it is necessary that the inverse filter set in the filter units 341 and 342 has the amplitude component in the high frequency band. However, the amplitude component in the high frequency band of the inverse filter which cancels the ear canal transfer characteristic has little influence on the out-of-head localization process. For example, in the band of 14 kHz or more, even if the headphone characteristic is not cancelled, there is an effect of the out-of-head localization. Therefore, according to the method indicated in Japanese Unexamined Patent Application Publication No. 2015-126269, the amplitude component in the high frequency band can be set. That is, the amplitude at the high boundary frequency indicated in Japanese Unexamined Patent Application Publication No. 2015-126269 and the Nyquist frequency may be set as the amplitude in the high frequency band.

FOURTH EMBODIMENT

Figure 17:
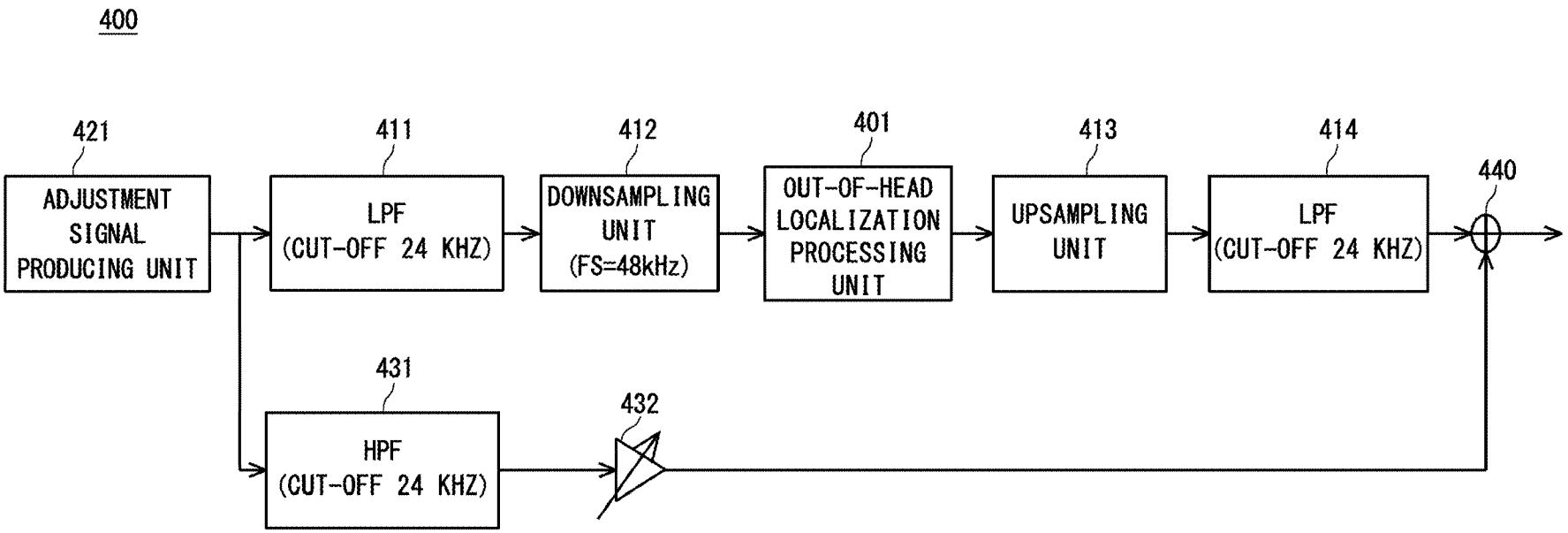
FIG. 17 is a block diagram showing the out-of-head localization device according to a forth embodiment.

In the fourth embodiment, the auditory test is performed in a different method. Hereinafter, the out-of-head localization device for performing the auditory test will be described using FIG. 17. In FIG. 17, mainly, only the process for performing the auditory test is described. That is, in the following description, the process for deciding the optimum filter from the plurality of trial listening filters is described. Since the out-of-head localization process using the optimum filter is the same as that of the third embodiment, further explanation will be omitted. For the illustration of example, the input unit, the headphone, and the setting storage unit is omitted.

An out-of-head localization device 400 is equipped with an adjustment signal production unit 421, an LPF (low pass filter) 411, a downsampling unit 412, an out-of-head localization unit 401, an upsampling unit 413, an LPF 414, an HPF (high pass filter) 431, a variable amplifier 432, and an adder 440.

The adjustment signal production unit 421, as the same as the adjustment signal production unit 521, produces an adjustment signal for deciding the optimum filter. That is, the adjustment signal production unit 421 outputs the HR signal picked up at the sampling frequency of 96 kHz as the adjustment signal. The sampling frequency of the adjustment signal is 96 kHz. The adjustment signal produced by the adjustment signal production unit 421 is inputted into the LPF 411 and HPF 431.

The LPF 411 is a low pass filter having a cutoff frequency of 24 kHz. Therefore, the LPF 411 allows the component in the low frequency band to pass through, and cuts off the component in the high frequency band. The downsampling unit 412 performs downsampling on the adjustment signal passing through the LPF 411. Therefore, the sampling frequency of the adjustment signal becomes 48 kHz. The downsampling unit 412 outputs the adjustment signal which has been subjected to downsampling, to the out-of-head localization unit 401.

Figure 16:
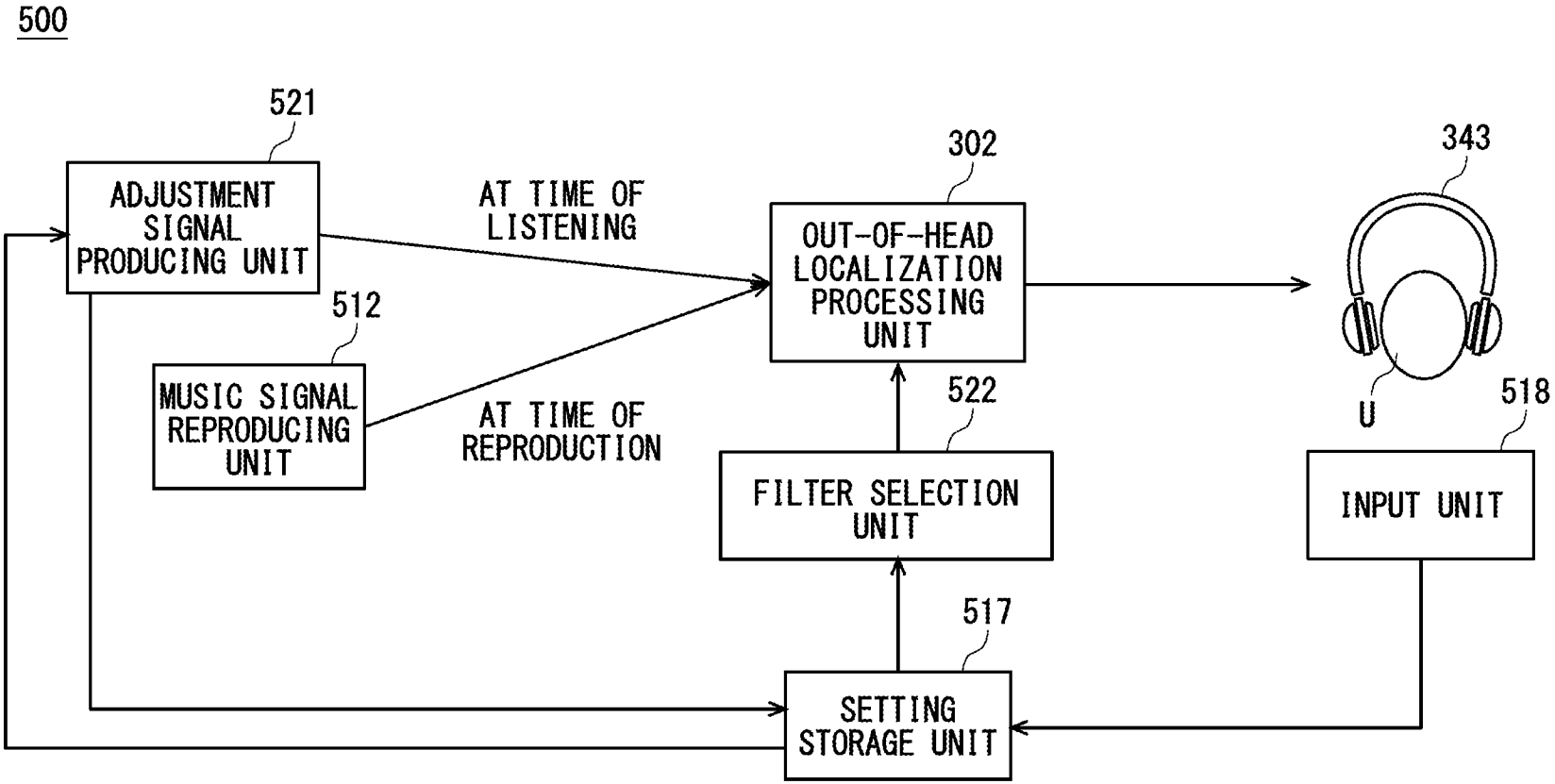
FIG. 16 is a block diagram showing the out-of-head localization device for performing an auditory sensation test in the third embodiment.

The out-of-head localization unit 401 corresponds to the out-of-head localization unit 302 shown in the FIG. 16. Therefore, the out-of-head localization unit 401 is equipped with the transfer characteristic processing unit 310, the filter unit 341, and the filter unit 342, which are shown in FIG. 9. The out-of-head localization unit 401 performs the out-of-head localization process to the adjustment signal which has been subjected to downsampling. The sampling frequency of the adjustment signal is downsampled to 48 kHz, so that the out-of-head localization unit 401 can use the transfer characteristics H'ls, H'lo, H'ro, and H'rs. Also, the transfer characteristics H'ls, H'lo, H'ro, and H'rs are measured by the structure shown in FIG. 10, and is measured by the HR signal non-corresponding microphone.

Next, the upsampling unit 413 performs upsampling on the adjustment signal which has been subjected to the out-of-head localization process. Therefore, the sampling frequency of the adjustment signal becomes 96 kHz. The LPF 414 is a low pass filter having a cutoff frequency of 24 kHz. Therefore, the LPF 414 allows the component in the low frequency band to pass through, and cuts off the component in the high frequency band. The adjustment signal passing through the LPF 414 is inputted in the adder 440.

Also, the adjustment signal produced in the adjustment signal production unit 421 is inputted in the HPF 431. The HPF 431 is a high pass filter having a cutoff frequency of 24 kHz. Therefore, the HPF 431 allows the component in the high frequency band to pass through, and cuts off the component in the low frequency band. The adjustment signal passing through the HPF 431 is amplified with the variable amplifier 432 and is inputted in the adder 440. The adder 440 adds the adjustment signal from the LPF 414 and the adjustment signal from the variable amplifier 432 to output the same to the headphone. That is, the component in the low frequency band and the component in the high frequency band are combined by the adder 440.

Hereby, the out-of-head localization process using the filter is performed only on the component in the low frequency band, which has passed through the LPF 411. That is, the out-of-head localization process using the filter is not performed on the component in the high frequency band, which has passed through the HPF 431. The component in the high frequency band and the component in the low frequency band which have been thus processed are combined by the adder 440, and are outputted from the headphone.

Here, by changing an amplification rate of the variable amplifier 432, the auditory test can be performed. For example, the amplification rate of the variable amplifier 432 is gradually or continuously increased. Then, input is performed at the timing when the listener U has the best auditory feeling. Therefore, the optimum amplification rate can be decided.

Figure 18:
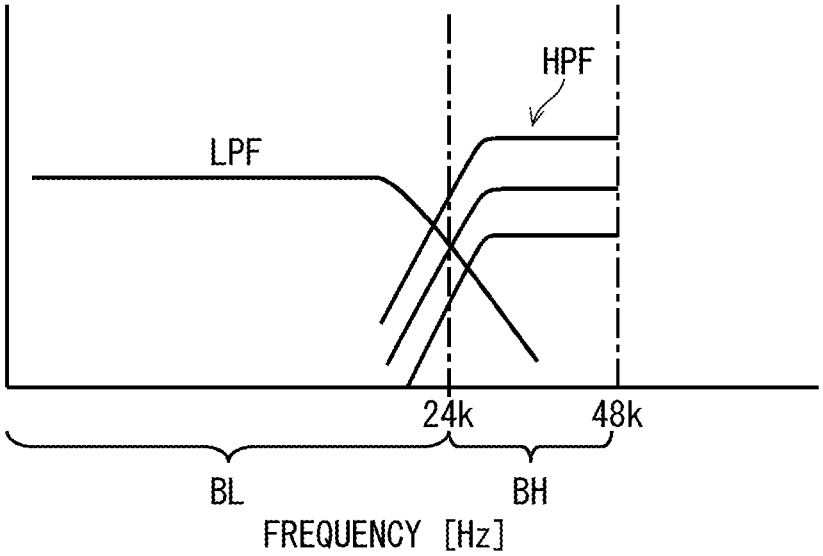
FIG. 18 illustrates the frequency characteristics of a HPF and a LPF.

FIG. 18 is a graph schematically showing frequency characteristics of the HPF 431 in the auditory test. In FIG. 18, a frequency is taken on an axis of abscissas, and a gain is taken on an axis of ordinates. FIG. 18 also illustrates frequency characteristics of the LPFs 411, 414. Varying the amplification factor of the variable amplifier 432 in a stepwise manner allows the HPF 431 to acquire the frequency characteristic shown in FIG. 18. In other words, the gain of the HPF 431 can be adjusted. The gain of the HPF 431 can be increased or decreased relative to the gain of the LPFs 411, 414.

Accordingly, an auditory test can be performed while the component in a high frequency band is varied. The level of a component in a high frequency band can be adjusted so as to conform to the level of a component in a low frequency band. In other words, it is possible to connect the component in the high frequency band to the component in the low frequency band. With such a configuration, the listener U can determine an optimal filter among the plurality of filters for trial listening. Further, an optimal filter can be generated based on the measurement result of a microphone which is not compatible with an HR signal.

THIRD MODIFIED EXAMPLE

Figure 19:
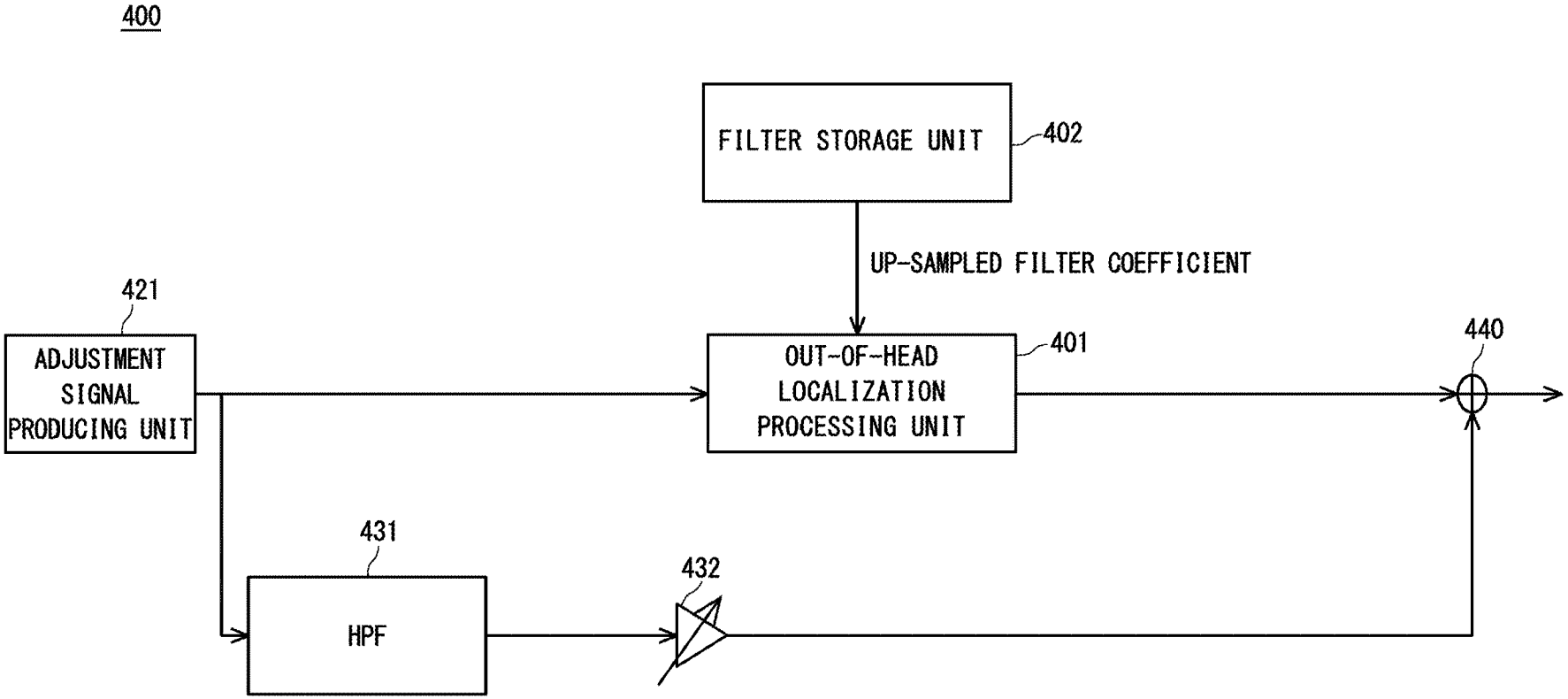
FIG. 19 is a block diagram showing the out-of-head localization device according to a third modified example.

In a third modified example, an auditory test is performed by a processing different from the processing in the fourth embodiment. FIG. 19 is a block diagram showing the configuration of the out-of-head localization device 400 according to the third modified example. In the third modified example, a filter storage unit 402 stores a filter where transfer characteristics H'ls, H'lo, H'ro, H'rs are up-sampled. The out-of-head localization unit 401 performs an out-of-head localization process using the up-sampled filter coefficient. The description of contents substantially equal to the corresponding contents in the above-mentioned embodiments is omitted when appropriate.

The adjustment signal production unit 421 outputs adjustment signals to the out-of-head localization unit 401 and an HPF 431. The adjustment signals are HR signals so that a sampling frequency is 96 kHz. The out-of-head localization unit 401 performs an out-of-head localization process on the adjustment signal. The adjustment signal on which the out-of-head localization process is performed in the out-of-head localization unit 401 is outputted to the adder 440.

In the same manner as in the fourth embodiment, the HPF 431 is a high pass filter where a cutoff frequency is 24 kHz. Accordingly, the HPF 431 allows a component in a high frequency band to pass therethrough, but cuts off a component in a low frequency band. An adjustment signal which is allowed to pass through the HPF 431 is amplified by the variable amplifier 432 and, then, is inputted into the adder 440. The adder 440 adds the adjustment signal from the LPF 414 to the adjustment signal from the variable amplifier 432, and outputs the acquired signal to headphones. That is, a component in a low frequency band and a component in a high frequency band are synthesized by the adder 440.

As described above, the out-of-head localization unit 401 performs the out-of-head localization process using an up-sampled filter coefficient. A component in a high frequency band which is allowed to pass through the HPF 431 is not subjected to the out-of-head localization process using a filter. Components in all bands which are processed as described above and a component in a high frequency band are synthesized by the adder 440, and are outputted from the headphones.

In this modified example, an auditory test can be performed by varying the amplification factor of the variable amplifier 432. For example, the amplification factor of the variable amplifier 432 is increased in a stepwise manner or in a continuous manner. Further, a listener U performs an input operation at timing of the most excellent auditory feeling. With such an input, an optimal amplification factor can be determined. With such operations, advantageous effects substantially equal to the advantageous effects in the fourth embodiment can be acquired.

In the third and fourth embodiments, a frequency (first frequency) forming a boundary between the high frequency band BH and the low frequency band BL is set to 24 kHz. However, the first frequency may be any frequency provided that the first frequency is lower than a Nyquist frequency. Alternatively, one listener U may perform an auditory test using two methods in the third and fourth embodiments so as to determine an optimal filter. In the third and fourth embodiments, the out-of-head localization process is performed using headphones. However, in the same manner as in the second embodiment, a sound image may be reproduced using a speaker.

A part or the whole of the above-described signal processing may be performed by a computer program. The above-mentioned program can be stored and provided to the computer using any type of non-transitory computer readable medium. The non-transitory computer readable medium includes any type of tangible storage medium. Examples of the non-transitory computer readable medium include magnetic storage medium (such as flexible disks, magnetic tapes, hard disk drives, etc.), optical magnetic storage medium (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire and an optical fiber or a wireless communication line.

Although embodiments of the invention made by the inventors are described in the foregoing, the present invention is not limited to the above-described embodiments, and various changes and modifications may be made without departing from the gist of the invention.

This disclosure is applicable to the generation of a filter which performs an out-of-head localization process.

What is claimed is:

1. A filter generation device configured to generate a filter for performing an out-of-head localization process on a high resolution digital audio signal, the filter generation device comprising:

a filter generation unit configured to generate, based on a sound pickup signal, a filter corresponding to a transfer characteristic from a sound source to left and right microphones, wherein the left and right microphones is configured to pick up a measurement signal outputted from a sound source so as to acquire the sound pickup signal, the left and right microphones are capable of being put on left and right ears of a listener;

the sound pickup signal is a signal with a predetermined sampling frequency, and a predetermined frequency lower than a Nyquist frequency of the sound pickup signal is assumed as a first frequency, the filter contains an amplitude component in a low frequency band which includes a frequency lower than the first frequency, and an amplitude component in a high frequency band which includes a frequency equal to or higher than the first frequency, the filter generation unit sets the amplitude component in the low frequency band of the filter corresponding to a frequency amplitude characteristic of the transfer characteristic, and the filter generation unit generates the amplitude component in the high frequency band of the filter such that the amplitude component in the high frequency band is allowed to be connected to the amplitude component in the low frequency band.

2. The filter generation device according to claim 1, wherein a first amplitude value of the first frequency of the filter is set based on an amplitude value of the frequency amplitude characteristic of the transfer characteristic at the first frequency.

3. The filter generation device according to claim 2, wherein a value obtained by correcting the amplitude value of the frequency amplitude characteristic of the transfer characteristic at the first frequency is set as the first amplitude value.

4. The filter generation device according to claim 2, wherein an amplitude component in the high frequency band of the filter is set based on the first amplitude value.

5. The filter generation device according to claim 2, wherein in a first band ranging from a second frequency lower than the first frequency to the first frequency, a second amplitude value is extracted from the frequency amplitude characteristic of the transfer characteristic, and the amplitude component in the high frequency band is generated while being prevented from exceeding the second amplitude value.

6. The filter generation device according to claim 5, wherein the second amplitude value is extracted corresponding to a peak of the frequency amplitude characteristic of the transfer characteristic in the first band.

7. The filter generation device according to claim 5, wherein an amplitude component in the first band of the filter is calculated so as to interpolate between the second amplitude value and the first amplitude value.

8. The filter generation device according to claim 1, wherein the amplitude component in the high frequency band is estimated by a simulation based on frequency characteristic data of an output unit which outputs a high resolution digital audio signal to a listener.

9. The filter generation device according to claim 8, wherein a level of the amplitude component in the high frequency band is adjusted so as to allow the amplitude component in the high frequency band to be connected to an amplitude component in the low frequency band.

10. The filter generation device according to claim 8, wherein smoothing processing is performed in a second band, disposed on a low frequency side in the high frequency band, so as to allow the amplitude component in the high frequency band to be connected to an amplitude component in the low frequency band.

11. The filter generation device according to claim 8, wherein smoothing processing is performed in a third band, disposed on a high frequency side in the low frequency band, so as to allow the amplitude component in the high frequency band to be connected to an amplitude component in the low frequency band.

12. The filter generation device according to claim 8, wherein smoothing processing is performed in a fourth band, which covers a first frequency, so as to allow the amplitude component in the high frequency band to be connected to an amplitude component in the low frequency band.

13. The filter generation device according to claim 1, wherein in a state where a high resolution microphone compatible with a high resolution digital audio signal is put on left and right ears of a person other than the listener or on left and right ears of a dummy head, the amplitude component in the high frequency band is set based on a frequency amplitude characteristic of a transfer characteristic of a high resolution sound pickup signal acquired.

14. An out-of-head localization device configured to perform an out-of-head localization process using a filter, the out-of-head localization device comprising:

an adjustment signal production unit configured to produce an adjustment signal which is a high resolution digital audio signal;

an out-of-head localization unit configured to perform an out-of-head localization process on the adjustment signal using a plurality of filters for trial listening; and a setting unit configured to set, based on a result of trial listening performed by changing over the plurality of filters for trial listening, a music reproduction filter which is to be used for reproducing a high resolution digital audio signal by selecting from the plurality of filters for trial listening, wherein each of the plurality of filters for trial listening is generated by the filter generation device according to claim 1.

15. A method for generating a filter for performing an out-of-head localization process on a high resolution digital audio signal, the method comprising the steps of:

outputting a measurement signal from a sound source; and picking up the measurement signal using left and right microphones capable of being put on left and right ears of a listener so as to acquire a sound pickup signal, wherein the method further comprises the step of generating, based on the sound pickup signal, a filter corresponding to a transfer characteristic from the sound source to the left and right microphones, the sound pickup signal is a signal with a predetermined sampling frequency, and a predetermined frequency lower than a Nyquist frequency of the sound pickup signal is assumed as a first frequency, the filter contains an amplitude component in a low frequency band which includes a frequency equal to or lower than the first frequency, and an amplitude component in a high frequency band which includes a frequency higher than the first frequency, and in the step of generating the filter, the amplitude component in the low frequency band of the filter is set corresponding to a frequency amplitude characteristic of the transfer characteristic, and the amplitude component in the high frequency band of the filter is generated such that the amplitude component in the high frequency band is allowed to be connected to the amplitude component in the low frequency band.

16. A non-transitory computer readable medium storing a program configured to cause a computer to perform the method for generating a filter according to claim 15.

* * * * *